US008294622B2

(12) United States Patent
Amari et al.

(10) Patent No.: US 8,294,622 B2
(45) Date of Patent: Oct. 23, 2012

(54) ARRAY ANTENNA APPARATUS SUFFICIENTLY SECURING ISOLATION BETWEEN FEEDING ELEMENTS AND OPERATING AT FREQUENCIES

(75) Inventors: Satoru Amari, Osaka (JP); Atsushi Yamamoto, Kyoto (JP); Tsutomu Sakata, Osaka (JP)

(73) Assignee: Panasonic Corporation, Osaka (JP)

( * ) Notice: Subject to any disclaimer, the term of this patent is extended or adjusted under 35 U.S.C. 154(b) by 340 days.

(21) Appl. No.: 12/864,370

(22) PCT Filed: Nov. 9, 2009

(86) PCT No.: PCT/JP2009/005951
§ 371 (c)(1),
(2), (4) Date: Jul. 23, 2010

(87) PCT Pub. No.: WO2010/061541
PCT Pub. Date: Jun. 3, 2010

(65) Prior Publication Data

US 2010/0295741 A1 Nov. 25, 2010

(30) Foreign Application Priority Data

Nov. 25, 2008 (JP) ..... 2008-299185

(51) Int. Cl.
*H01Q 1/24* (2006.01)

(52) U.S. Cl. ..... 343/702; 343/850

(58) Field of Classification Search ..... 343/702, 343/700 MS, 850, 876
See application file for complete search history.

(56) References Cited

U.S. PATENT DOCUMENTS 6,295,030 B1 * 9/2001 Kozakai et al. ..... 343/700 MS
6,771,223 B1 8/2004 Shoji et al.
6,894,648 B2 5/2005 Kozakai
7,554,497 B2 * 6/2009 Ohba et al. ..... 343/702
(Continued)

FOREIGN PATENT DOCUMENTS

JP 2001-267841 9/2001
(Continued)

OTHER PUBLICATIONS

International Preliminary Report on Patentability and Written Opinion of the International Searching Authorities issued Jul. 14, 2011in corresponding International (PCT) Application No. PCT/JP2009/005951.

(Continued)

*Primary Examiner* — Hoang V Nguyen
(74) *Attorney, Agent, or Firm* — Wenderoth, Lind & Ponack, L.L.P.

(57) ABSTRACT

An array antenna apparatus includes a first antenna element resonating at a first frequency and a second antenna element resonating at the first frequency, and includes a first connecting line that connects the first connection point located in the first antenna element with a third connection point located in the second antenna element, and a second connecting line that connects the second connection point located in the first antenna element with a fourth connection point located in the second antenna element. Electrical lengths of the first and second antenna elements and those of the first and second connecting lines are set so that a phase difference, between first and second high-frequency signals respectively propagating through first and second signal paths, becomes substantially 180 degrees at the first feeding point, and then, the array antenna apparatus resonances at the first frequency and the second frequency.

19 Claims, 19 Drawing Sheets

U.S. PATENT DOCUMENTS

| | | | |
|---|---|---|---|
| 7,557,761 | B2 | 7/2009 | Iwai et al. |
| 2002/0000937 | A1 | 1/2002 | Kozakai |
| 2008/0174508 | A1 | 7/2008 | Iwai et al. |

FOREIGN PATENT DOCUMENTS

| | | |
|---|---|---|
| JP | 2004-207929 | 7/2004 |
| JP | 2006-237660 | 9/2006 |
| JP | 2008-199588 | 8/2008 |
| WO | 02/39544 | 5/2002 |

OTHER PUBLICATIONS

International Search Report issued Feb. 9, 2010 in International (PCT) Application No. PCT/JP2009/005951.

S. Ranvier et al., "Mutual Coupling Reduction for Patch Antenna Array", Proceedings of EuCAP 2006, Nice in France, ESA SP-626, Oct. 2006.

* cited by examiner

ARRAY ANTENNA APPARATUS SUFFICIENTLY SECURING ISOLATION BETWEEN FEEDING ELEMENTS AND OPERATING AT FREQUENCIES

BACKGROUND OF THE INVENTION

1. Field of the Invention

The present invention relates to an array antenna apparatus capable of sufficiently securing isolation between feeding elements and operating at a plurality of frequencies and to a wireless communication apparatus employing the same.

2. Description of the Related Art

In recent years, size reduction and thickness reduction in portable wireless communication apparatuses such as portable telephones have been rapidly promoted. Moreover, the portable wireless communication apparatuses have been not only used as conventional telephones but also achieved transfiguration as data terminal equipment for transceiving electronic mails and browsing web pages by www (World Wide Web) and so on. The information to be handled has been increased in capacity from the conventional sound and character information to photographs and motion pictures, and a further improvement in the communication quality has been demanded. Under these circumstances, an antenna apparatus using a MIMO (Multi-Input Multi-Output) technique for simultaneously transceiving wireless signals of a plurality of channels by an array antenna apparatus having a plurality of antenna elements is proposed.

As a technique for improving the coupling deterioration of an array antenna, a configuration provided with a phase shifter circuit is disclosed (See a Patent Document 1). According to the Patent Document 1, an antenna apparatus that transmits and receives radio waves of two frequencies is characterized in that the feeding points of two antenna elements having resonance frequencies different from each other are connected to a wireless circuit via respective two phase shifter circuits for changing the phase. In such an antenna apparatus, connection of an antenna element to the feeding point via the phase shifter circuit leads to that the impedance characteristic of the adjacent other antenna element at the resonance frequency can be adjusted to be high. Therefore, the influence between the antenna elements can be removed, and use at relatively adjacent frequencies different from each other is possible with a simple configuration.

As a technique for improving the coupling deterioration of the array antenna, such a configuration that the current paths of the antennas are different from each other is disclosed (See a Patent Document 2). In the Patent Document 2, an antenna apparatus having a conductive substrate of a rectangular shape and a flat plate-shaped antenna provided via a dielectric on the substrate is disclosed. The antenna apparatus is characterized in that a current flows in one diagonal direction on the substrate by excitation of the antenna in a predetermined direction, and a current flows in the other diagonal direction on the substrate by excitation of the antenna in a different direction. As described above, the antenna apparatus of the Patent Document 2 can prevent the occurrence of such a problem that the two antennas of the antenna apparatus are electromagnetically coupled with each other by changing the direction of the current flow on the substrate.

Patent and non-patent documents related to the present invention are as follows:

Patent Documents:

Patent Document 1: Japanese patent laid-open publication No. JP 2001-267841 A; and Patent Document 2: International Publication No. WO2002/039544.

Non-Patent documents:

Non-Patent Document 1: S. Ranvier et al., "Mutual Coupling Reduction For Patch Antenna Array", Proceedings of EuCAP 2006, Nice in France, ESA SP-626, October 2006.

However, according to the system disclosed in the Patent Document 1, the resonance frequencies of two elements are different from each other, and one antenna element becomes high impedance when used at the resonance frequency of the other antenna element. Therefore, the apparatus can not be used for the maximum ratio combining method (MRC: Maximum Ratio Combining)) for simultaneously driving two elements at an identical frequency to change the phase and the MIMO antenna apparatus. Moreover, according to the system disclosed in the Patent Document 2, it is possible to restrain such a problem that the antennas are electromagnetically coupled with each other by changing the current paths of the antennas. However, the apparatus, which is unable to perform simultaneous operation in a manner similar to that of the Patent Document 1 due to the execution of switchover, can not be used for the MRC and MIMO antenna apparatus.

Moreover, when an array antenna is provided for a compact wireless communication apparatus like a portable telephone, it is compelled to have a shortened distance between the feeding elements, and therefore, this has led to such a problem that the isolation between the feeding elements has become insufficient. Furthermore, it is desirable to provide an antenna apparatus capable of operating in a plurality of frequency bands in addition to the capability of performing the MIMO communication in order to perform, for example, communications with respect to a plurality of applications. Such an antenna apparatus has not been disclosed in the Patent Documents 1 and 2.

FIG. 29 is a plan view of a prior art array antenna apparatus disclosed in the Non-Patent Document 1. Referring to FIG. 29, patch antennas 71 and 72 are foamed on a dielectric substrate 70, and they are fed via microstrip lines 73 and 74, respectively. In this case, as indicated by arrow 76, a microstrip line 75 is connected between the microstrip lines 73 and 74 before the feeding points in order to cancel a high-frequency signal that propagates through the space from the patch antenna 71, and enters the patch antenna 72. However, there has been such a problem that the design of a spatial coupling of a reversed phase has been extremely difficult in order to cancel the high-frequency signal entering the patch antenna 72 from the patch antenna 71.

SUMMARY OF THE INVENTION

It is an object of the present invention to solve the aforementioned problems and provide an array antenna apparatus that can be used for, for example, MIMO communication and so on and operable in a plurality of frequency bands capable of sufficiently securing isolation between feeding elements even with a simple configuration and a wireless communication apparatus having such an array antenna apparatus.

According to the first aspect of the present invention, there is provided an array antenna apparatus includes first and second antenna elements, and first and second connecting lines. The first antenna element is connected to a first feeding point, and the first antenna element resonates at a first frequency. The second antenna element is connected to a second feeding point, and the second antenna element resonates at the first frequency. The first connecting line electrically connects the first connection point located in the first antenna element with a third connection point located in the second antenna element, and the second connecting line electrically connects the second connection point located in the first antenna element with a fourth connection point located in the second antenna element. An electrical length of each of the first and second antenna elements and an electrical length of each of the first and second connecting lines are set so that a phase difference, between a first high-frequency signal propagating through a first signal path that extends from the second feeding point via the third connection point, the first connecting line and the first connection point to the first feeding point, and a second high-frequency signal propagating through a second signal path that extends from the second feeding point via the fourth connection point, the second connecting line and the second connection point to the first feeding point, becomes substantially 180 degrees at the first feeding point. This leads to that the array antenna apparatus resonates at a plurality of frequencies including the first frequency and a second frequency higher than the first frequency.

In the above-mentioned array antenna apparatus, the phase difference may be set so as to become substantially 180 degrees at an averaged frequency of the first frequency and the second frequency.

In addition, the above-mentioned array antenna apparatus may further include first to fourth phase shifters. The first phase shifter is connected between the first connection point and the second connection point, and the second phase shifter is connected between the first connection point and the third connection point. The third phase shifter is connected between the third connection point and the fourth connection point, and the fourth phase shifter is connected between the second connection point and the fourth connection point.

Further, in the above-mentioned array antenna apparatus, each of the first to fourth phase shifters may be a 90-degree phase shifter for shifting a phase of an inputted high-frequency signal substantially by 90 degrees and outputting a phase-shifted signal.

Still further, in the above-mentioned array antenna apparatus, each of the first to fourth phase shifters may be a low-pass filter for interrupting a high-frequency signal including the second frequency, and the low-pass filter may be configured to include an inductor and a capacitor.

In addition, in the above-mentioned array antenna apparatus, each of the first to fourth phase shifters may be a parallel resonance circuit having a resonance frequency of the second frequency and interrupting a high-frequency signal having the second frequency, and the parallel resonance circuit may be configured to include an inductor and a capacitor.

Further, in the above-mentioned array antenna apparatus, each of the first to fourth phase shifters may include a parallel resonance circuit and a series resonance circuit. The parallel resonance circuit is configured to have a resonance frequency of the second frequency, interrupt the high-frequency signal having the second frequency, and include an inductor and a capacitor. The series resonance circuit is configured to have a resonance frequency of the first frequency, allow the high-frequency signal having the first frequency to pass therethrough, and include an inductor and a capacitor.

Still further, in the above-mentioned array antenna apparatus, the first antenna element and the second antenna element may be configured to become mutually asymmetrical circuits.

Still further, in the above-mentioned array antenna apparatus, a parallel resonance circuit having a further resonance frequency other than the first frequency and the second frequency may be inserted into at least one location of the first antenna element and the second antenna element, the location excluding:

a position located between the first connection point and the second connection point, between which the first phase shifter is connected;

a position located between the first connection point and the third connection point, between which the second phase shifter is connected;

a position located between the third connection point and the fourth connection point, between which the third phase shifter is connected; and a position located between the second connection point and the fourth connection point, between which the fourth phase shifter is connected.

This leads to that the array antenna apparatus resonates at the further resonance frequency other than the first frequency and the second frequency.

According to the second aspect of the present invention, there is provided a wireless communication apparatus including the above-mentioned array antenna apparatus, and a wireless communication circuit for performing wireless communications by using the array antenna apparatus.

According to the array antenna apparatus of the present invention, there can be provided the array antenna apparatus that can be used for, for example, MIMO communication and so on and operable in a plurality of frequency bands with sufficiently securing isolation between feeding elements, and the wireless communication apparatus having the above array antenna apparatus. Therefore, according to the present invention, a sufficient isolation can be secured or established between the feeding elements upon performing MIMO communication in a frequency band on the higher frequency side. Further, it is possible to perform communication of another application in the frequency band on the lower frequency side without increasing the number of feeding elements.

As the greatest advantageous effect of the present invention, by providing a phase shifter circuit in which, for example, four 90-degree phase shifters are connected together in series in the antenna element, the high-frequency signals are fed to the two feeding point of the one antenna element. Moreover, the isolation between antennas can be lowered even when they are simultaneously driven. By configuring the 90-degree phase shifter circuit of an inductor and a capacitor of lumped-parameter elements, giving a 90-degree phase rotation in the frequency band on the lower frequency side and selecting a constant that becomes open at the frequency on the higher frequency side, resonances in a plurality of frequency bands can be achieved.

DETAILED DESCRIPTION OF THE PREFERRED EMBODIMENTS

Figure 1:
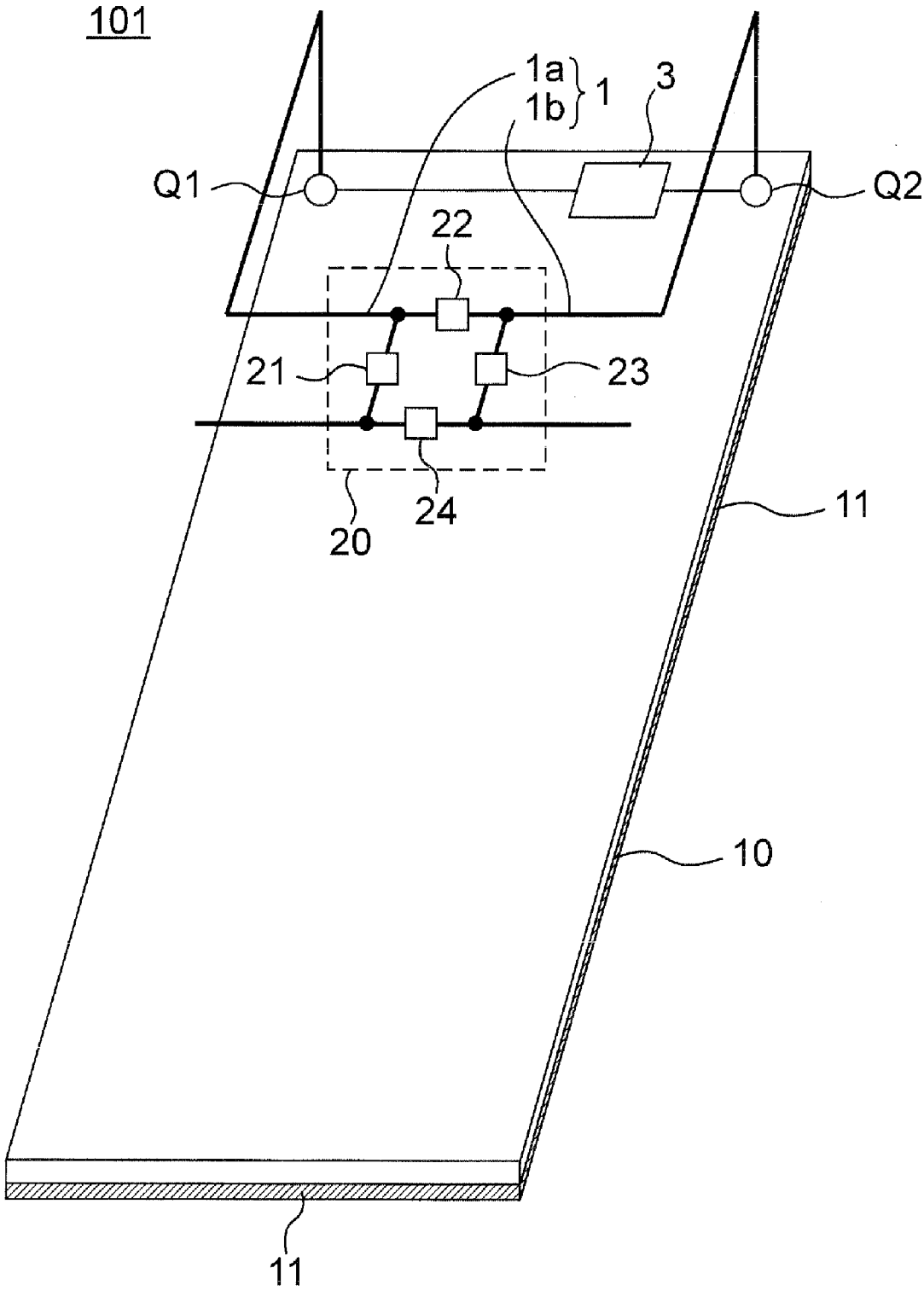
FIG. 1 is a perspective view showing an external appearance of a portable telephone array antenna apparatus 101 according to one preferred embodiment of the present invention.

Preferred embodiments of the present invention will be described below with reference to the drawings. In the following preferred embodiments, like components are denoted by like reference numerals.

FIG. 1 is a perspective view showing an external appearance of a portable telephone array antenna apparatus 101 according to one preferred embodiment of the present invention. The array antenna apparatus 101 of the present preferred embodiment is characterized by including a phase shifter circuit 20 as configured to connect both ends of one linear antenna element 1 to two feeding points Q1 and Q2 on a dielectric circuit substrate 10 whose rear surface is made of a metal grounding conductor 11 and connecting in series four 90-degree phase shifters 21 to 24 between the feeding points Q1 and Q2 in the antenna element 1. In this case, a wireless communication circuit 3 (shown in FIG. 1 but omitted in the subsequent figures) is connected to the feeding points Q1 and Q2, and the antenna element 1 is divided into two linear antenna element portions 1*a* and 1*b*, and the phase shifter circuit 20 is inserted into the point of division.

Figure 2:
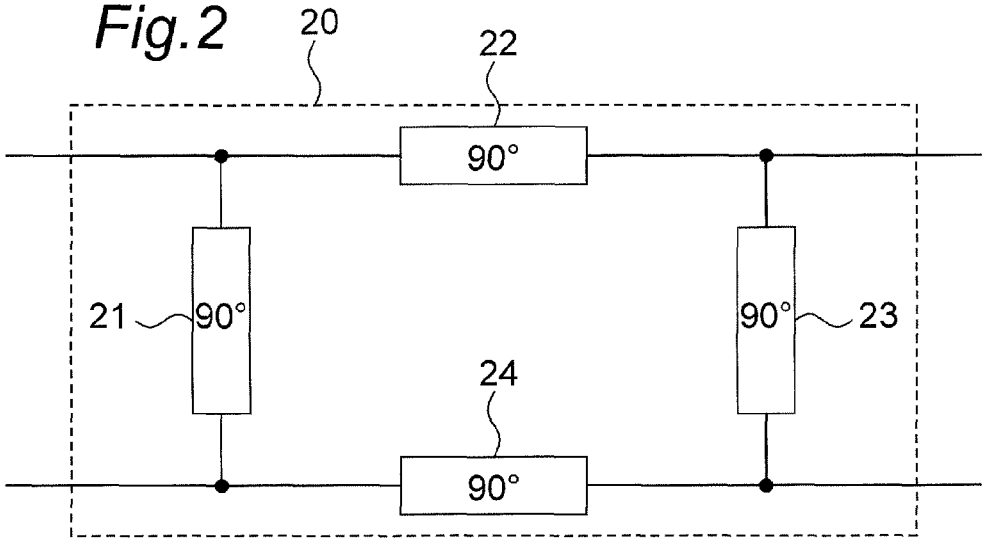
FIG. 2 is a circuit diagram showing an inner structure of the phase shifter circuit 20 of FIG. 1.

FIG. 2 is a circuit diagram showing an inner structure of the phase shifter circuit 20 of FIG. 1. Referring to FIG. 2, the phase shifter circuit 20 is configured to include the four 90-degree phase shifters 21 to 24 connected mutually in series in a grating form. In this case, the 90-degree phase shifters 21 to 24 shift an inputted high-frequency signal substantially by 90 degrees and output the resulting signal. In operation in a frequency band on the higher frequency side, the high-frequency signal of the frequency band on the higher frequency side is interrupted by the phase shifter circuit 20, and MIMO communication is performed by mutually independent excitation of the antenna element portions 1*a* and 1*b* from the feeding points Q1 and Q2, respectively. In operation in a frequency band on the lower frequency side, wireless communication is performed by double-frequency operation by excitation of a linear antenna connected between the feeding points Q1 and Q2. In this case, as shown in FIG. 1, the array antenna apparatus 101 is provided with the feeding points Q1 and Q2 located on the circuit board 10 and the feeding points Q1 and Q2 provided mutually separated apart by a predetermined distance, for example, in an identical plane.

Figure 3:
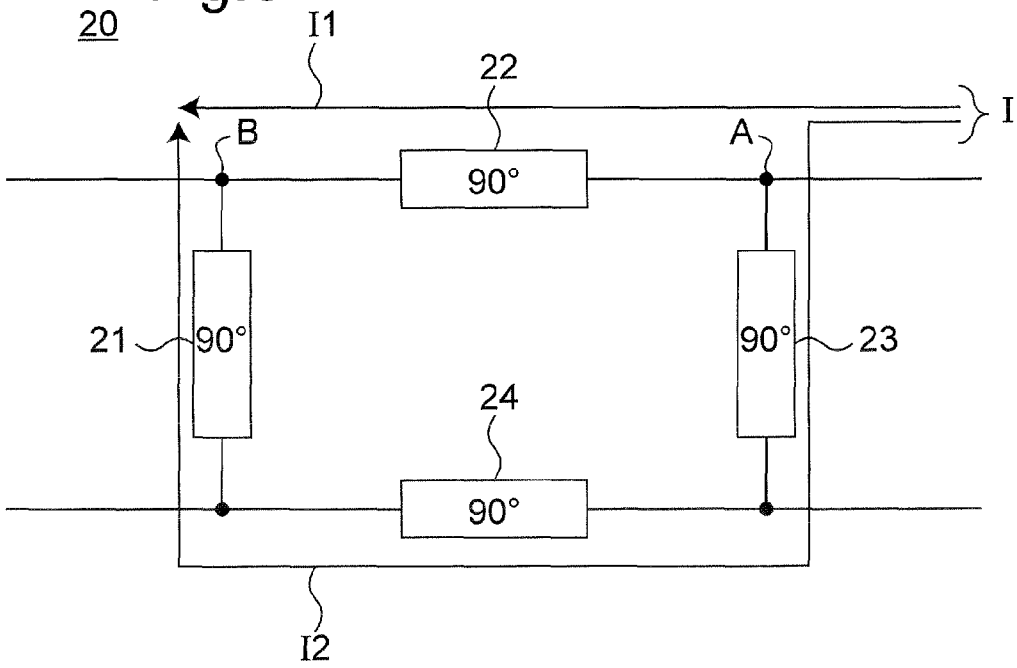
FIG. 3 is a circuit diagram showing current paths of a phase shifter circuit 20 of FIG. 2.

FIG. 3 is a circuit diagram showing current paths of the phase shifter circuit 20 of FIG. 2. That is, FIG. 3 is a diagram showing currents flowing from the feeding point Q2 to the antenna element 1. A current I from the feeding point Q2 is divided at a point A into a current I1 on the 90-degree phase shifter 22 side and a current I2 on the 90-degree phase shifter 23 side. If the point A is served as a reference of phase, then the current I1 that has reached the point B has a phase advanced by 90 degrees with respect to the point A. In contrast to this, the current I2 passes through the 90-degree phase shifters 23, 24 and 21, and therefore, a current having a phase advanced by 270 degrees with respect to the point A reaches the point B. Therefore, since the current I1 and the current I2 have a phase difference of 180 degrees at the point B, both of them cancel each other, and the current from the feeding point Q2 does not enter the feeding point Q1. Therefore, isolations of both of them can be made very high even in such a state that two feeding points are provided for one antenna element 1. Conversely, the same thing can be said for the current from the feeding point Q1.

Figure 4A:
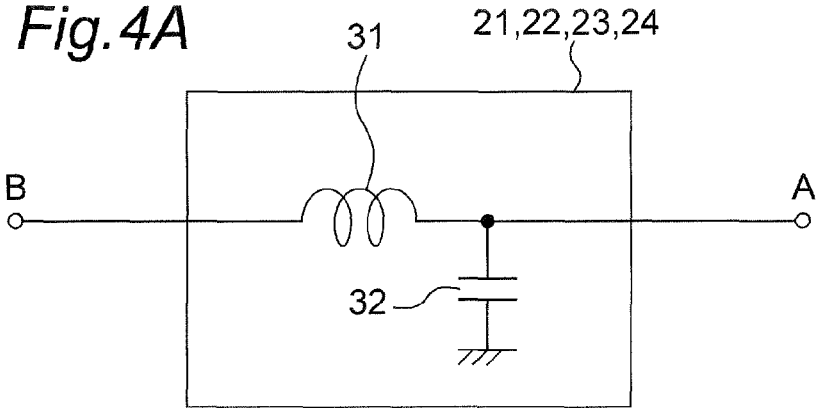
FIG. 4A is a circuit diagram showing a configuration of the 90-degree phase shifters 21, 22, 23 and 24 of FIG. 1.

FIG. 4A is a circuit diagram showing one example of the configurations of the 90-degree phase shifters 21, 22, 23 and 24 of FIG. 1. Referring to FIG. 4A, the 90-degree phase shifters 21, 22, 23 and 24 are configured to include an L-type circuit of an inductor 31 and a capacitor 32, and the circuit structure operates as a low-pass filter that allow the frequency component on the lower frequency side to pass therethrough and interrupts the frequency on the higher frequency side. The capacitor 32 may be configured to include a floating capacitance between the inductor 31 and the grounding conductor 11.

Figure 4B:
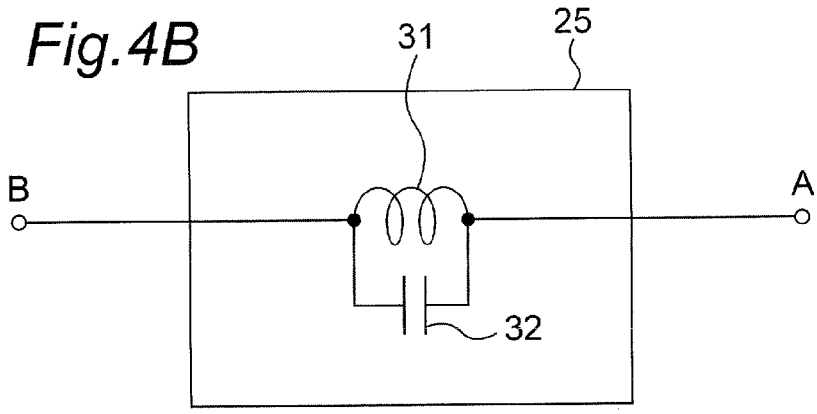
FIG. 4B is a circuit diagram showing a configuration of a first modified preferred embodiment of the circuit of FIG. 4A.

FIG. 4B is a circuit diagram showing a configuration of a first modified preferred embodiment of the circuit of FIG. 4A. Referring to FIG. 4B, a phase shifter 25 may be provided in place of the 90-degree phase shifters 21, 22, 23 and 24 of FIG. 4A. In this case, the phase shifter 25 is a parallel resonance circuit as configured to include the inductor 31 and the capacitor 32 to interrupt the high-frequency signal of the frequency band on the higher frequency side. That is, the phase shifter 25 can operate as a trap circuit by interrupting the high-frequency signal of the frequency band on the higher frequency side to allow the portable telephone array antenna apparatus to operate in a double-frequency operation manner.

Figure 4C:
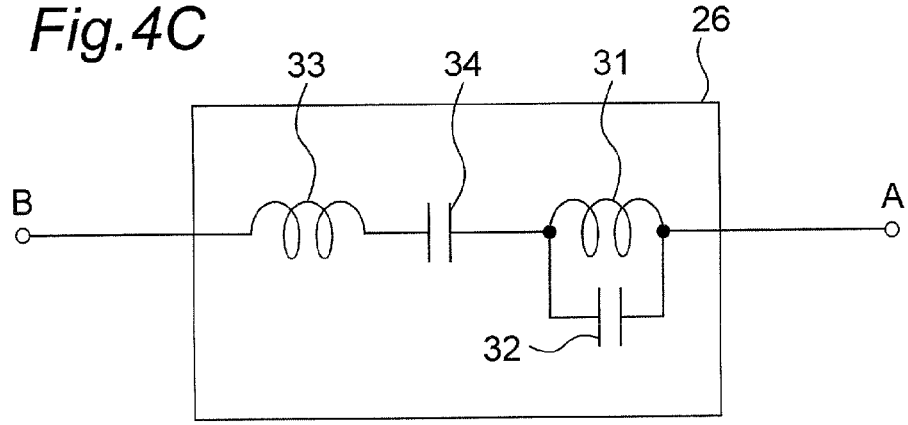
FIG. 4C is a circuit diagram showing a configuration of a second modified preferred embodiment of the circuit of FIG. 4A.

FIG. 4C is a circuit diagram showing a configuration of a second modified preferred embodiment of the circuit of FIG. 4A. Referring to FIG. 4C, a phase shifter 26 may be provided in place of the 90-degree phase shifters 21, 22, 23 and 24 of FIG. 4A. In this case, the phase shifter 26 is configured to connect in series a parallel resonance circuit as configured to include an inductor 31 and a capacitor 32 to interrupt the high-frequency signal of the frequency band on the higher frequency side and a series resonance circuit as configured to include an inductor 33 and a capacitor 34. In this case, the latter series resonance circuit is provided to perform adjustment in a manner that a phase difference between the two high-frequency signals becomes 180 degrees at the feeding point Q1 so that the high-frequency signal of the frequency band on the higher frequency side is made to pass, and two high-frequency signals that have passed through two current paths K1 and K2 (See FIG. 14) cancel each other at one feeding point Q1 located in the two current paths K1 and K2. When the directions of the currents become reversed to that of the above case, it is provided so that the two high-frequency signals, which have passed through the two current paths K1 and K2 (See FIG. 14), cancel each other at the feeding point Q2, and the phase difference between the two high-frequency signals becomes 180 degrees at the feeding point Q2. With this arrangement, the phase shifter 25 interrupts the high-frequency signal of the frequency band on the higher frequency side, and the two high-frequency signals, which have passed through the two current paths K1 and K2, cancel each other at the feeding point Q1 or Q2, allowing the portable telephone array antenna apparatus to operate in the double-frequency operation manner.

Figure 5A:
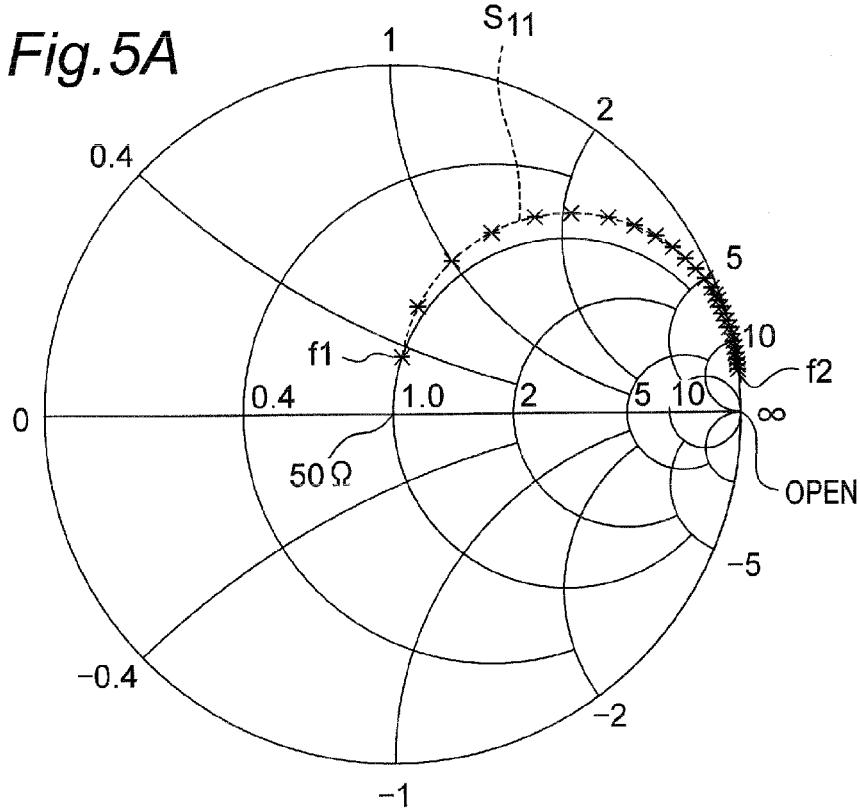
FIG. 5A is a Smith chart showing one example of a reflection coefficient $S_{11}$ of the 90-degree phase shifters 21, 22, 23 and 24 of FIG. 4A.
Figure 5B:
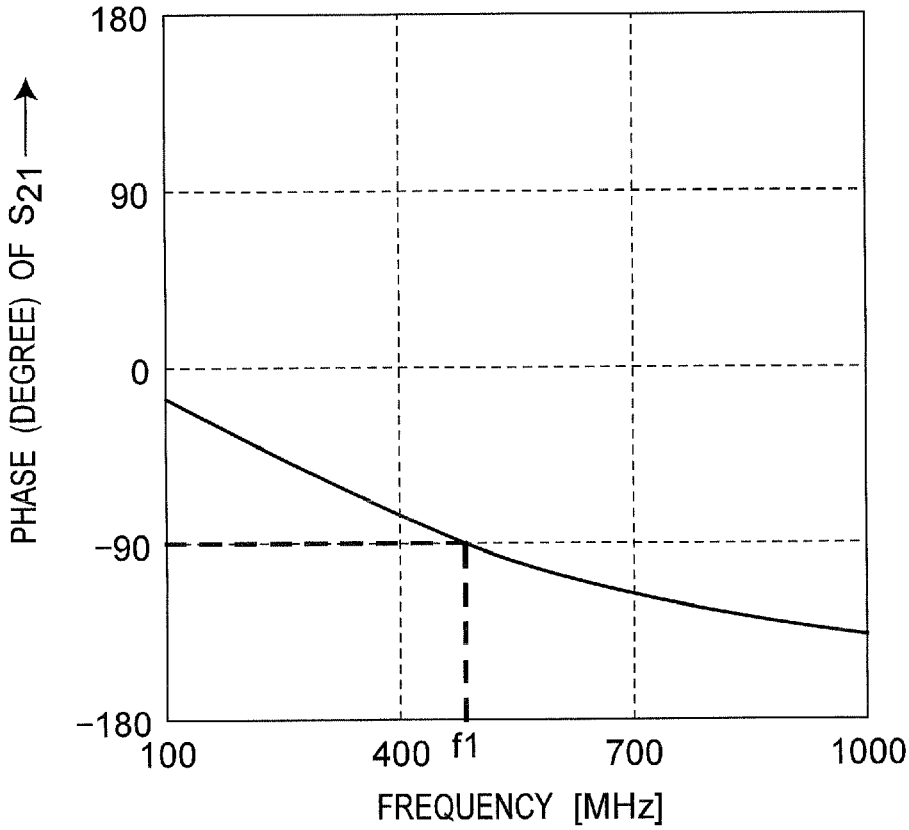
FIG. 5B is a graph showing one example of a transmission coefficient $S_{21}$ of the 90-degree phase shifters 21, 22, 23 and 24 of FIG. 4A.

FIG. 5A is a Smith chart showing one example of the reflection coefficient $S_{11}$ of the 90-degree phase shifters 21, 22, 23 and 24 of FIG. 4A, and FIG. 5B is a graph showing one example of the transmission coefficient $S_{21}$ of the 90-degree phase shifters 21, 22, 23 and 24 of FIG. 4A. Referring to FIGS. 5A and 5B, f1 and f2 denote frequencies, and they have a high and low correlation: f1<f2. As is apparent from FIG. 5A, it can be understood that the impedance is matched to 50Ω at the frequency f1 on the lower frequency side, and an impedance higher than 50Ω, is achieved at the frequency f2 on the higher frequency side. As is apparent from FIG. 5B, a phase difference between the points A and B is 90 degrees at the frequency f1, and this means that it operates as a 90-degree phase shifter in the circuit structure that employs the inductor 31 and the capacitor 32 of FIG. 4A.

Figure 6A:
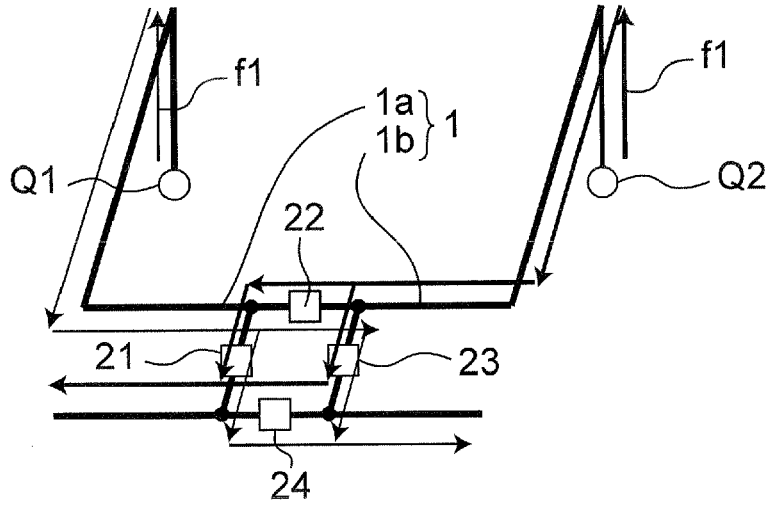
FIG. 6A is a circuit diagram showing current paths of the array antenna apparatus 101 of FIG. 1 at a frequency f1.
Figure 6B:
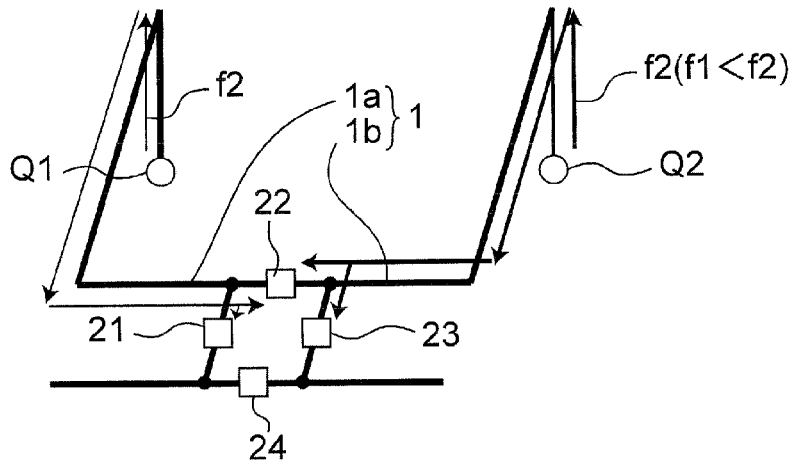
FIG. 6B is a circuit diagram showing current paths of the array antenna apparatus of FIG. 1 at a frequency f2 (f1<f2)

FIG. 6A is a circuit diagram showing current paths of the array antenna apparatus 101 of FIG. 1 at the frequency f1, and FIG. 6B is a circuit diagram showing current paths of the array antenna apparatus of FIG. 1 at the frequency f2 (f1<f2). That is, FIGS. 6A and 6B are diagrams showing such states that the antenna element 1 enters a double-resonance state. FIG. 6A shows current paths at the frequency f1 on the lower frequency side, and FIG. 6B shows current paths at the frequency f2 on the higher frequency side. As is apparent from FIGS. 6A and 6B, the frequency f1 on the lower frequency side passes through the phase shifter circuit 20, and the frequency 12 on the higher frequency side is interrupted before the phase shifter circuit 20. As described above, when the plurality of current paths of electrical lengths different from each other are provided for the antenna element, resonance states are obtained at the plurality of frequencies corresponding to the electrical lengths. In this case, the resonance states are established when the electrical length of a monopole antenna is set to, for example, nλc/4 (where "n" is a natural number, and λ is the wavelength).

In order to improve the communication quality in a wireless system, a plurality of channels are provided in, for example, a MIMO communication system. Each channel has a bandwidth corresponding to the wireless system. Since the magnitude of the phase is changed by the frequency as shown in FIG. 5B, the phase of the phase shifter disadvantageously inevitably deviates from 90 degrees in the band. Assuming that the amplitude of the current flowing in the antenna element 1 from the feeding point in FIG. 3 is Ia, and the error of the phase difference is Δθ, then the isolation Iso is expressed by the following equation:

$$Iso = 20 \times \log_{10}\left(\frac{\sqrt{Ia}}{2}e^{j(90+\Delta\theta)} + \frac{\sqrt{Ia}}{2}e^{j(270+3\Delta\theta)}\right) \quad (1)$$

Figure 7:
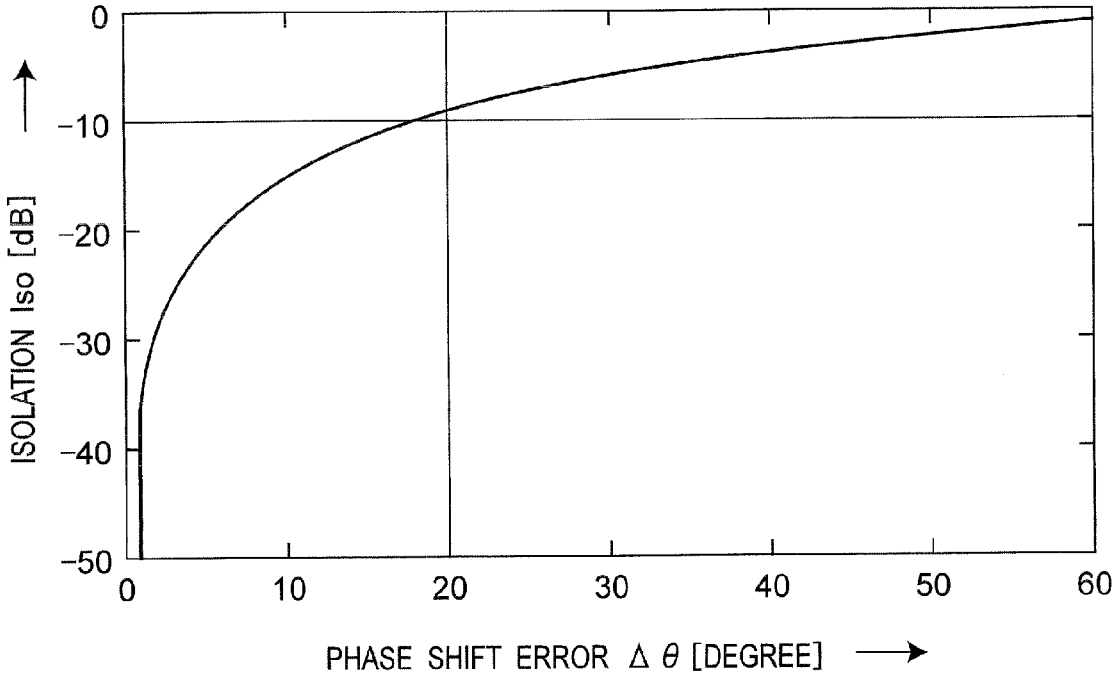
FIG. 7 is a graph showing a relation between the phase shift error and isolation of the 90-degree phase shifters 21, 22, 23 and 24 of FIG. 4A.

FIG. 7 is a graph showing a relation between the phase shift error Δθ and the isolation Iso of the 90-degree phase shifters 21, 22, 23 and 24 of FIG. 4A. That is, FIG. 7 is a diagram showing a relation between the phase shift errors of the 90-degree phase shifters 21, 22, 23 and 24 and the isolation Iso between the feeding points by using the Equation (1). It can be utilized for designing the 90-degree phase shifters 21, 22, 23 and 24 by the necessary bandwidth and isolation. For example, in the case of the double-frequency operation, the phase shift error $\Delta\theta$ may be about 18 degrees in order to secure the isolation Iso of 10 dB or more. That is, the phase difference of the phase shifters 21, 22, 23 and 24 is not limited to 90 degrees but allowed to be preferably 70 to 110 degrees, more preferably 72 to 108 degrees and most preferably 80 to 100 degrees. The phase difference may be set substantially to 90 degrees or in the vicinity of 90 degrees. Moreover, it is proper to set the phase difference of the phase shifters 21, 22, 23 and 24 substantially to 90 degrees at the intermediate frequency or the averaged frequency of the two frequencies f1 and f2 in the double-frequency operation.

Next, various modified preferred embodiments in place of the portable telephone array antenna apparatus 101 of the preferred embodiment of FIG. 1 are described below.

Figure 8A:
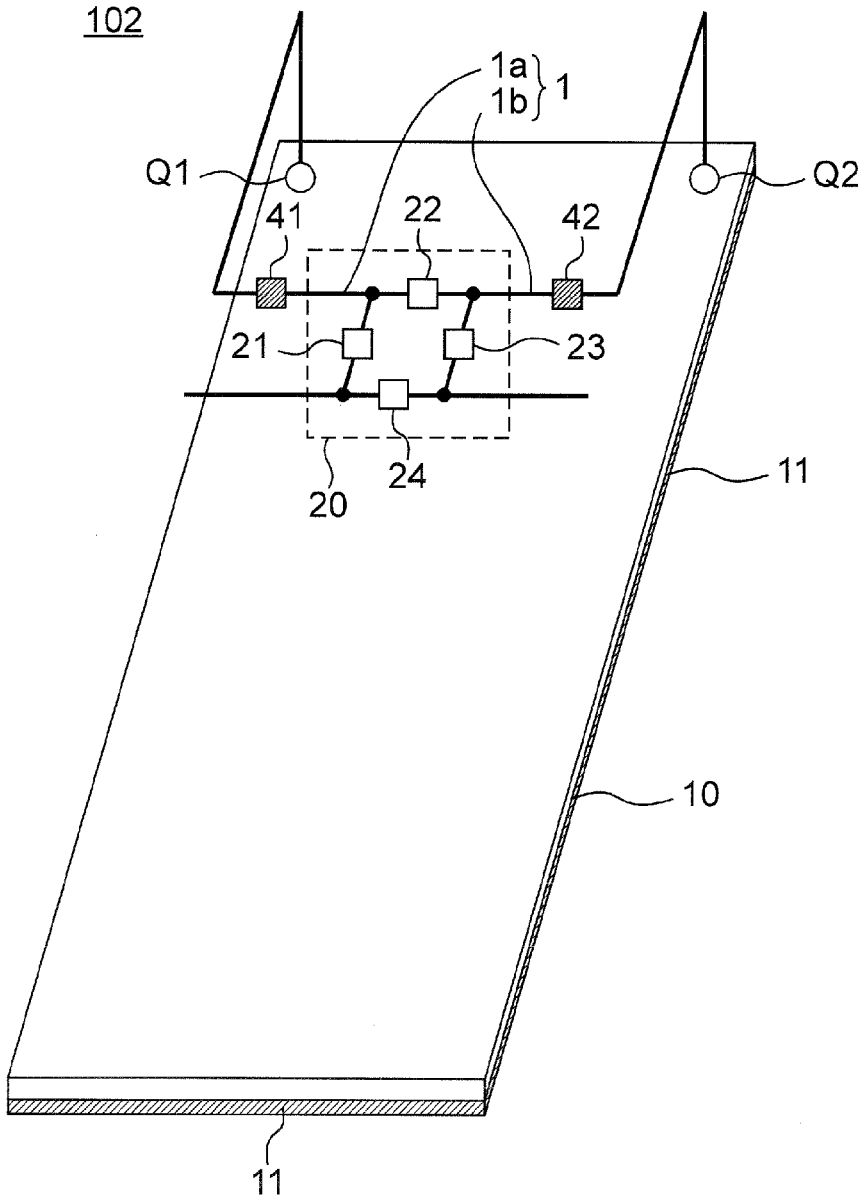
FIG. 8A is a perspective view showing an external appearance of a portable telephone array antenna apparatus 102 according to a first modified preferred embodiment of the present invention.
Figure 8B:
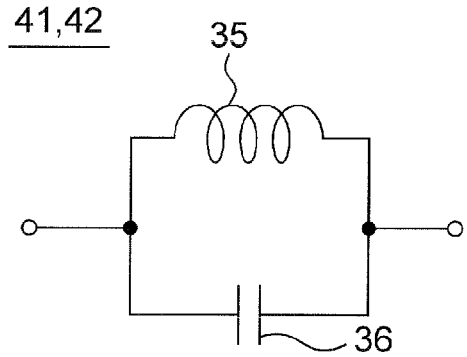
FIG. 8B is a circuit diagram showing one example of a parallel resonance circuit of FIG. 8A.

FIG. 8A is a perspective view showing an external appearance of a portable telephone array antenna apparatus 102 according to the first modified preferred embodiment of the present invention, and FIG. 8B is a circuit diagram showing one example of a parallel resonance circuit of FIG. 8A. Referring to FIG. 8A, the array antenna apparatus 102 is provided with two feeding points Q1 and Q2 of one antenna element 1 on a circuit board 10, and a phase shifter circuit 20 is provided between the two feeding points Q1 and Q2 in the antenna element 1. Further, it is characterized in that parallel resonance circuits 41 and 42 are provided between the phase shifter circuit 20 and the feeding points Q1 and Q2, respectively. Referring to FIG. 8B, the parallel resonance circuits 41 and 42 are each configured to include a parallel resonance circuit (trap circuit) of an inductor 35 and a capacitor 36 and able to interrupt specific frequency components and to allow the other frequency components to pass therethrough.

Figure 9A:
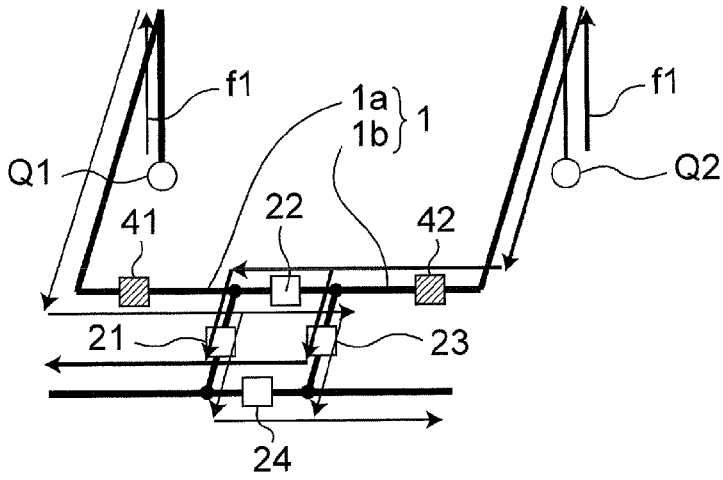
FIG. 9A is a circuit diagram showing current paths of the array antenna apparatus 102 of FIG. 8A at the frequency f1.
Figure 9B:
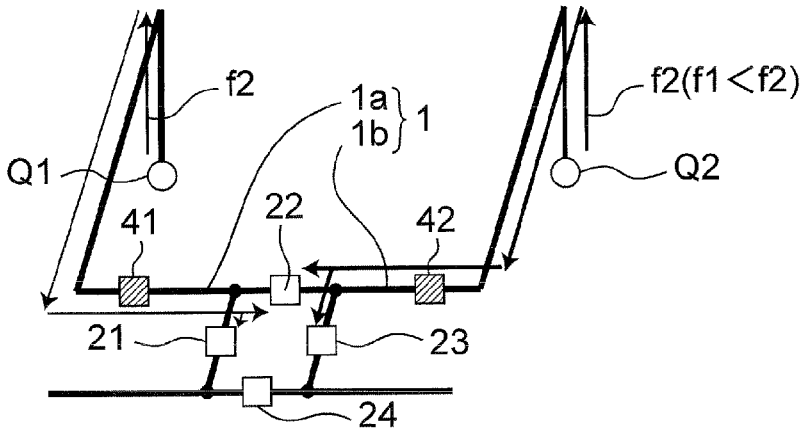
FIG. 9B is a circuit diagram showing current paths of the array antenna apparatus 102 of FIG. 8A at the frequency f2 (f1<f2)
Figure 9C:
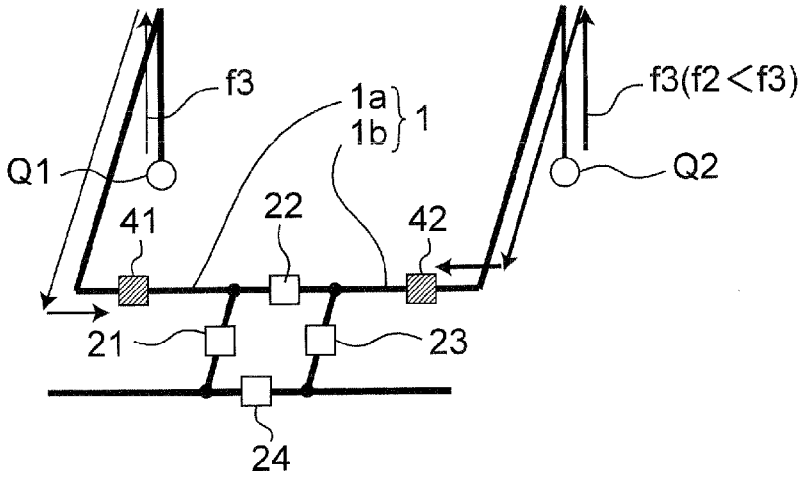
FIG. 9C is a circuit diagram showing current paths of the array antenna apparatus 102 of FIG. 8A at a frequency f3 (f2<f3)

FIG. 9A is a circuit diagram showing current paths of the array antenna apparatus 102 of FIG. 8A at a frequency f1. FIG. 9B is a circuit diagram showing current paths of the array antenna apparatus 102 of FIG. 8A at a frequency f2 (f1<f2). FIG. 9C is a circuit diagram showing current paths of the array antenna apparatus 102 of FIG. 8A at a frequency f3 (f2<f3). That is, FIGS. 9A through 9C are diagrams showing such a state that the antenna element 1 enters a triple-resonance state. As is apparent from FIGS. 9A through 9C, the frequency f1 on the lower frequency side passes through the parallel resonance circuits 41 and 42 and the phase shifter circuit 20, the frequency f2 is interrupted before the phase shifter circuit 20, and the frequency f3 is interrupted by the parallel resonance circuits 41 and 42. As described above, when a plurality of current paths of electrical lengths different from each other are provided for the antenna element 1, resonances are obtained at a plurality of frequencies such as three frequencies corresponding to their electrical lengths.

As described above, the array antenna apparatus of the present preferred embodiment is able to sufficiently secure isolation between the feeding elements even with a simple configuration and to operate in a plurality of frequency bands.

Figure 10:
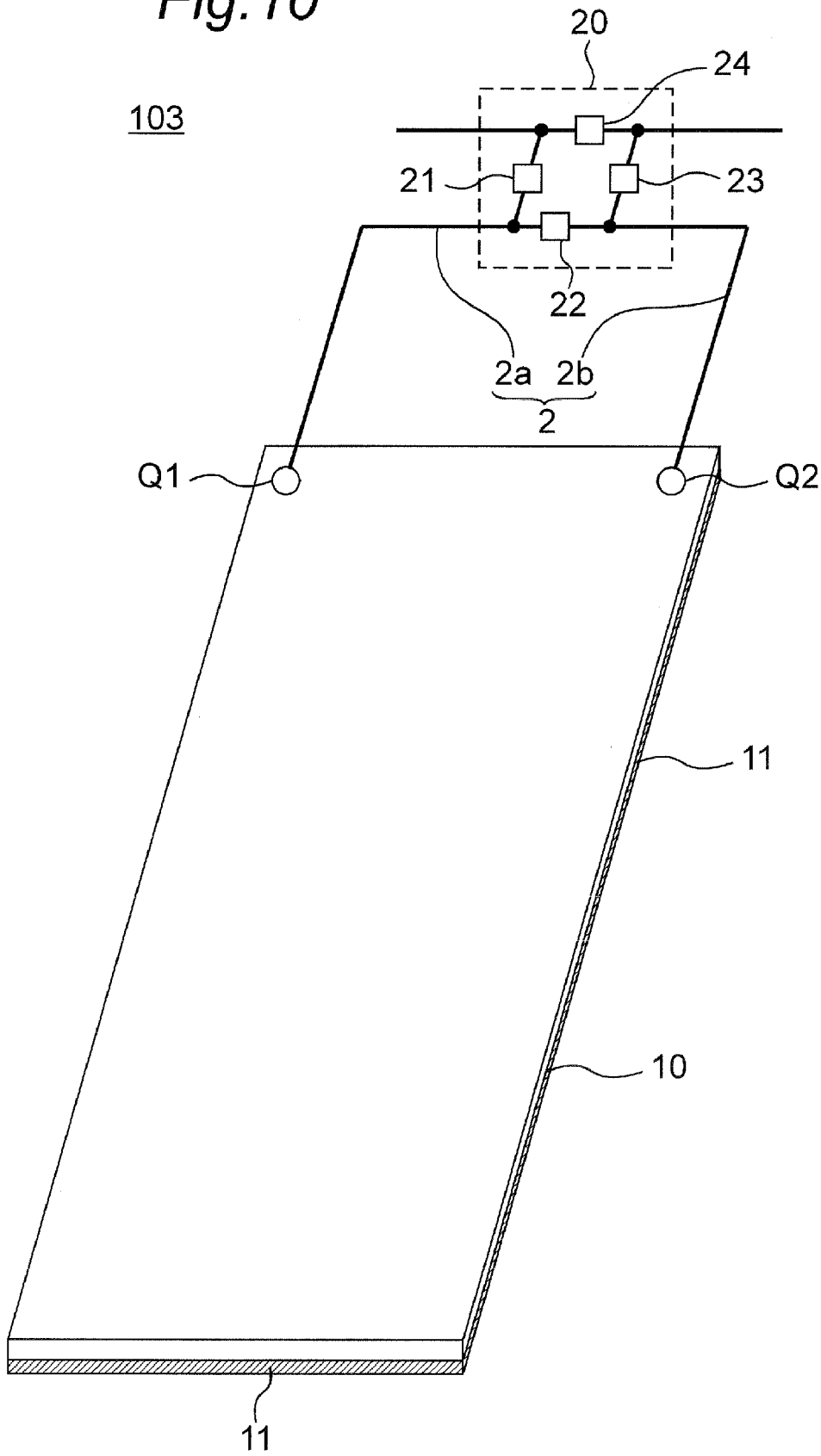
FIG. 10 is a perspective view showing an external appearance of a portable telephone array antenna apparatus 103 according to a second modified preferred embodiment of the present invention.

Although the antenna element 1 is provided on the surface of the circuit board 10 in a manner similar to that of FIG. 1 or FIG. 8A in the present preferred embodiment and the first modified preferred embodiment, the present invention is not limited to this. FIG. 10 is a perspective view showing an external appearance of a portable telephone array antenna apparatus 103 according to the second modified preferred embodiment of the present invention. Referring to FIG. 10, it is, of course, acceptable to provide the antenna element 2 outside the surface of the circuit board 10. Referring to FIG. 10, the antenna element 2 is divided into two antenna element portions 2*a* and 2*b*, and a phase shifter circuit 20 is inserted into the point of division.

Figure 11:
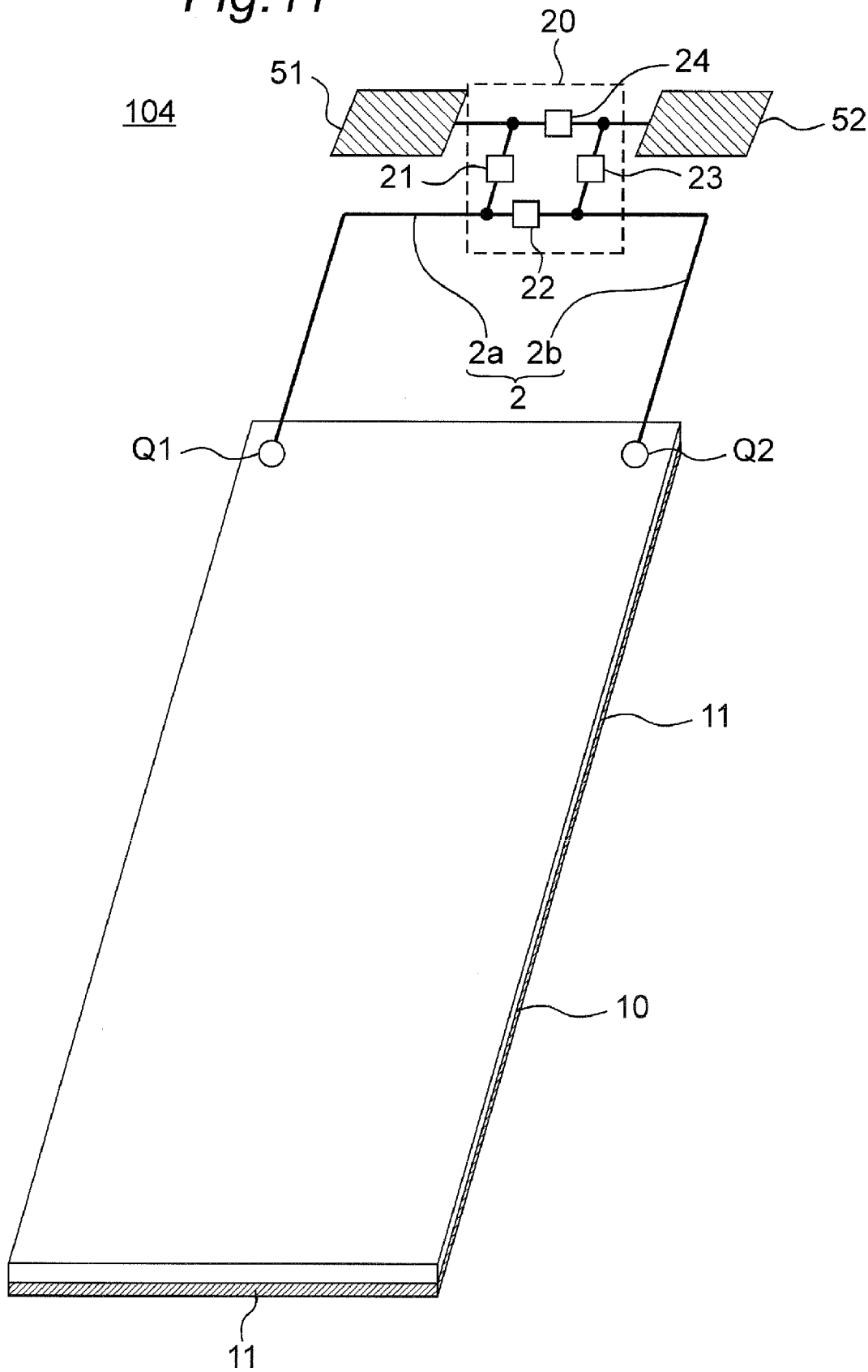
FIG. 11 is a perspective view showing an external appearance of a portable telephone array antenna apparatus 104 according to a third modified preferred embodiment of the present invention.

Although the linear antenna element 1 or 2 is provided in the above preferred embodiments and the modified preferred embodiments, the present invention is not limited to this. FIG. 11 is a perspective view showing an external appearance of a portable telephone array antenna apparatus 104 according to the third modified preferred embodiment of the present invention. In FIG. 11, the antenna element 2 may be partially or entirely (i.e., at least partially) provided by a plate-shaped antenna element. Referring to FIG. 11, the antenna element portions 2*a* and 2*b* are connected to two terminals of the phase shifter circuit 20, and plate-shaped antenna elements 51 and 52 are connected to the other two respective terminals.

Figure 12:
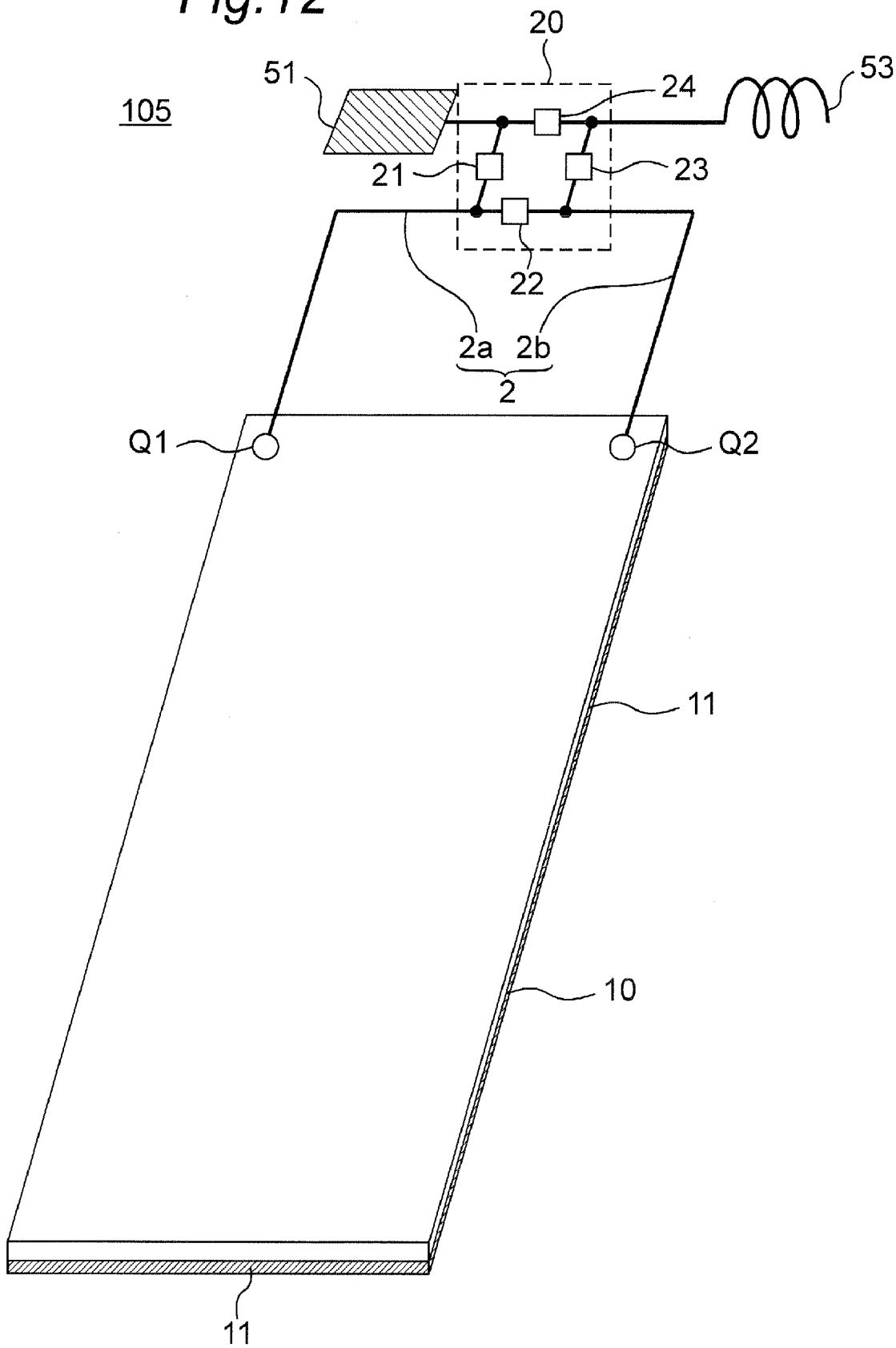
FIG. 12 is a perspective view showing an external appearance of a portable telephone array antenna apparatus 105 according to a fourth modified preferred embodiment of the present invention.

Although the antenna element 1 or 2 has a symmetrical circuit structure in the plane interposed between the feeding points Q1 and Q2 (roughly or substantially in a center portion of the antenna element 1 or 2) in the above preferred embodiments and modified preferred embodiments, the present invention is not limited to this but allowed to have an asymmetrical circuit structure. FIG. 12 is a perspective view showing an external appearance of a portable telephone array antenna apparatus 105 according to the fourth modified preferred embodiment of the present invention. Referring to FIG. 12, the antenna element 2 is not obliged to have a symmetrical circuit structure outside the phase shifter circuit 20 when seen from the feeding points Q1 and Q2. Referring to FIG. 12, the antenna element portions 2*a* and 2*b* are connected to two terminals of the phase shifter circuit 20, and a plate-shaped antenna element 51 and an inductor (extension coil) 53 are connected to the other two respective terminals.

Figure 13:
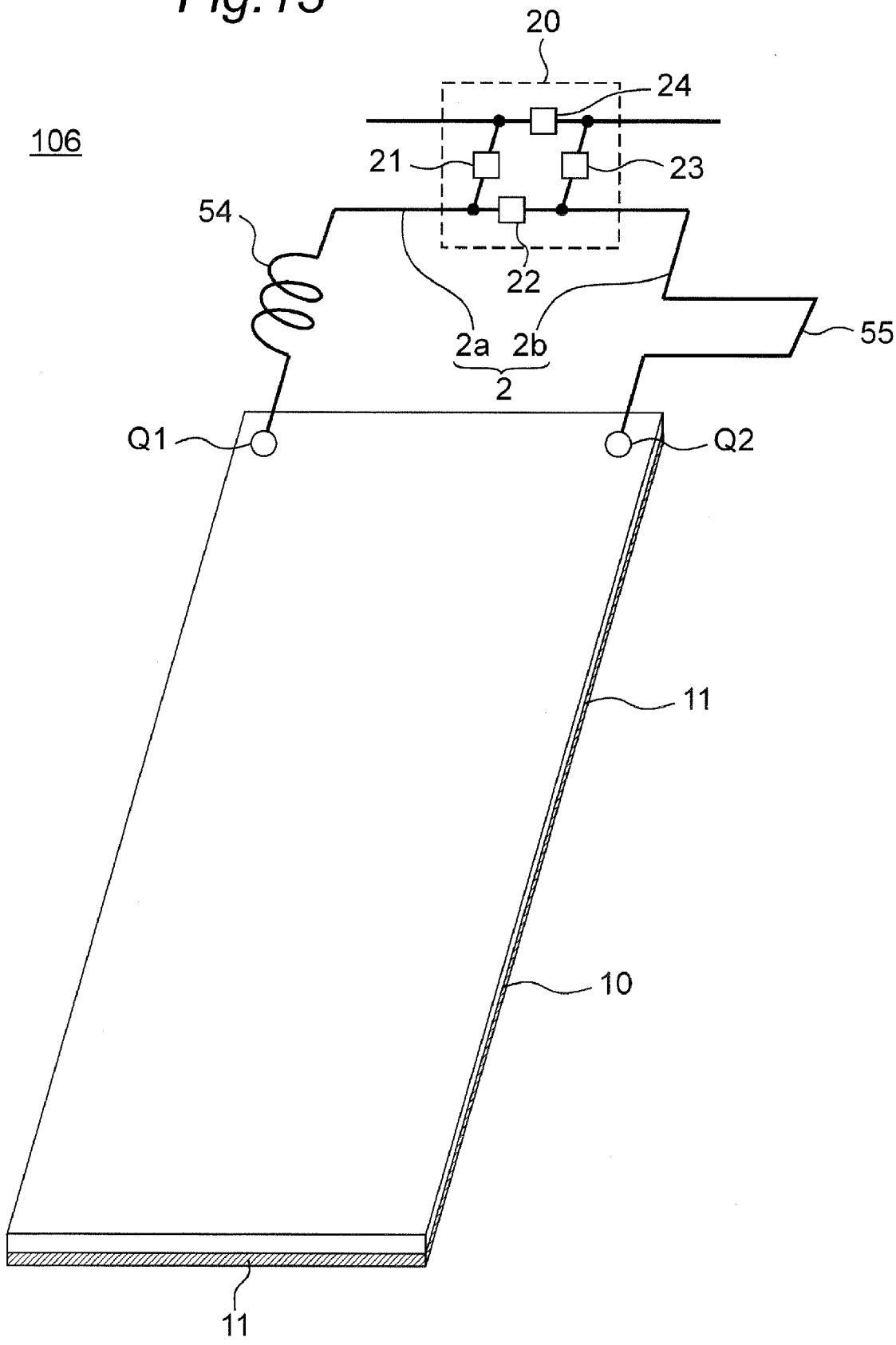
FIG. 13 is a perspective view showing an external appearance of a portable telephone array antenna apparatus 106 according to a fifth modified preferred embodiment of the present invention.

Although the antenna element 1 or 2 has a symmetrical circuit structure in the plane interposed between the feeding points Q1 and Q2 (roughly in the center portion of the antenna element 1 or 2) in the above preferred embodiments and modified preferred embodiments, the present invention is not limited to this but allowed to have an asymmetrical circuit structure. FIG. 13 is a perspective view showing an external appearance of a portable telephone array antenna apparatus 106 according to the fifth modified preferred embodiment of the present invention. Referring to FIG. 13, the antenna element 2 is not obliged to have a symmetrical circuit structure inside the phase shifter circuit 20 when seen from the feeding points Q1 and Q2 if the antenna element portions 2*a* and 2*b* have an equal electrical length. Referring to FIG. 13, the antenna element portion 2*a* is configured to include an inductor 54, and the antenna element portion 2*b* is configured to include an extended antenna element portion 55.

As described in detail above, according to the array antenna apparatus of the preferred embodiments and the modified preferred embodiments of the present invention, it is possible to provide an array antenna apparatus that can be used for, for example, MIMO communication and is capable of sufficiently securing an isolation between the feeding elements and operating in a plurality of frequency bands and a wireless communication apparatus that employs such an array antenna apparatus. Therefore, according to the present invention, a sufficient isolation between the feeding elements can be secured or established when performing MIMO communication in the frequency band on the higher frequency side. Further, it is possible to perform communications for another application in the frequency band on the lower frequency side without increasing the number of feeding elements.

As the greatest advantageous effect of the preferred embodiments of the present invention, one antenna element 1 is fed via the two feeding points Q1 and Q2 by configuring the phase shifter circuit 20 (as configured to connect in series four 90-degree phase shifter circuits 21 to 24) inside the antenna element 1. Moreover, the isolation between the antenna element portions can be lowered even when it is simultaneously driven. By configuring the 90-degree phase shifters 21 to 24 of the inductor 31 and the capacitor 32 of the lumped-parameter elements to give a 90-degree phase rotation in the frequency band on the lower frequency side and selecting a constant such that an open state is established at the frequency on the higher frequency side, resonances in the plurality of frequency bands can be achieved.

Figure 14:
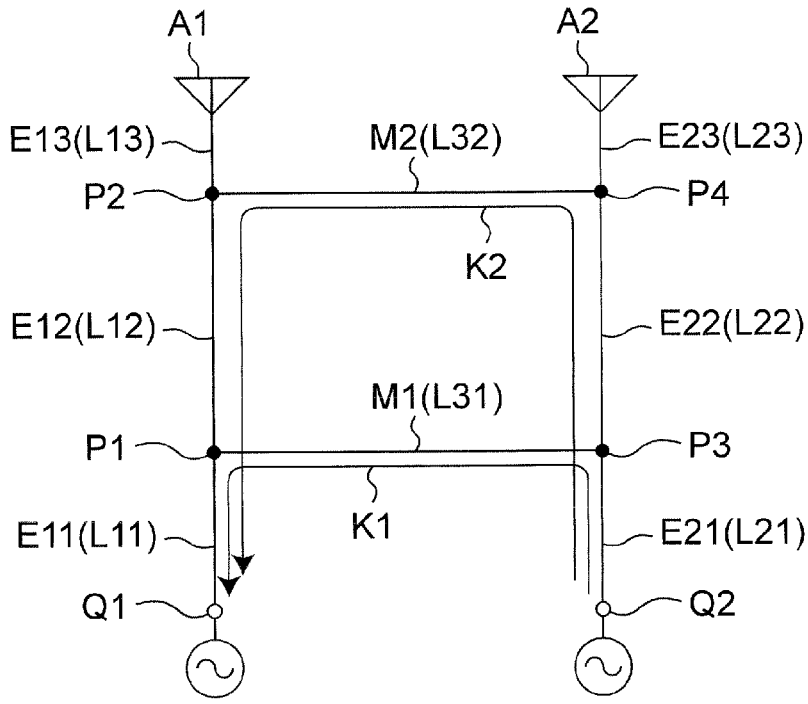
FIG. 14 is a circuit diagram of the portable telephone array antenna apparatus of the present invention.

FIG. 14 is a circuit diagram of the portable telephone array antenna apparatus of the present invention. That is, FIG. 14 is a circuit diagram showing an overview of the technical concept of the apparatus of the present invention. Referring to FIG. 14, at a location between the antenna element A1 and the antenna element A2, the connection point P1 of the antenna element A1 is electrically connected with the connection point P3 of the antenna element A2 via a connecting line M1 having an electrical length L31, and the connection point P2 of the antenna element A1 is electrically connected with the connection point P4 of the antenna element A2 having an electrical length L32. In this case, the antenna element A1 is configured to include an antenna element portion E11 having an electrical length L11, an antenna element portion E12 having an electrical length L12, and an antenna element portion E13 having an electrical length L13. Moreover, the antenna element A2 is configured to include an antenna element portion E21 having an electrical length L21, an antenna element portion E22 having an electrical length L22, and an antenna element portion E23 having an electrical length L23.

The array antenna apparatus as configured as above is set so that, the antenna element A1 having an electrical length (=L11+L12+L13) enters a resonance state at the frequency f1 on the lower frequency side when a high-frequency signal of the frequency f1 on the lower frequency side is inputted to the feeding point Q1, and the antenna element A2 having an electrical length (=L21+L22+L23) enters a resonance state at the frequency f1 on the lower frequency side when the high-frequency signal of the frequency f1 on the lower frequency side is inputted to the feeding point Q2. Moreover, when a high-frequency signal of the frequency f2 on the higher frequency side is inputted to the feeding point Q1, it is set so that the antenna element apparatus having a first electrical length (=L11+M1+L22+L23) or a second electrical length (=L11+L12+M2+L23) enters a resonance state at the frequency f2 on the higher frequency side, and the antenna element apparatus having a third electrical length (=L21+M1+L12+L13) or a second electrical length (=L21+L22+M2+L13) enters a resonance state at the frequency f2 on the higher frequency side. In this case, for example, when the current of the high-frequency signal of the frequency f1 on the lower frequency side fed at the feeding point Q2 flows via the antenna element portion E21, the connecting line M1 and the antenna element portion E11 to the feeding point Q1 through a current path K1. On the other hand, a current of the high-frequency signal of the frequency f1 on the lower frequency side fed at the feeding point Q2 flows via the antenna element portion E21, the antenna element portion E22, the connecting line M2, the antenna element portion E12 and the antenna element portion E11 to the feeding point Q1 through a current path K2, each electrical length is adjusted so that the high-frequency signals flowing via these two current paths K1 and K2 become to have mutually reversed phases at the feeding point Q1. The same thing can be said for the current of the high-frequency signal of the frequency f1 on the lower frequency side fed at the feeding point Q1. By performing adjustment as described above, the array antenna apparatus can be operated at the two frequencies f1 and f2, and the predetermined isolation can be obtained between the two antenna elements A1 and A2.

Figure 15:
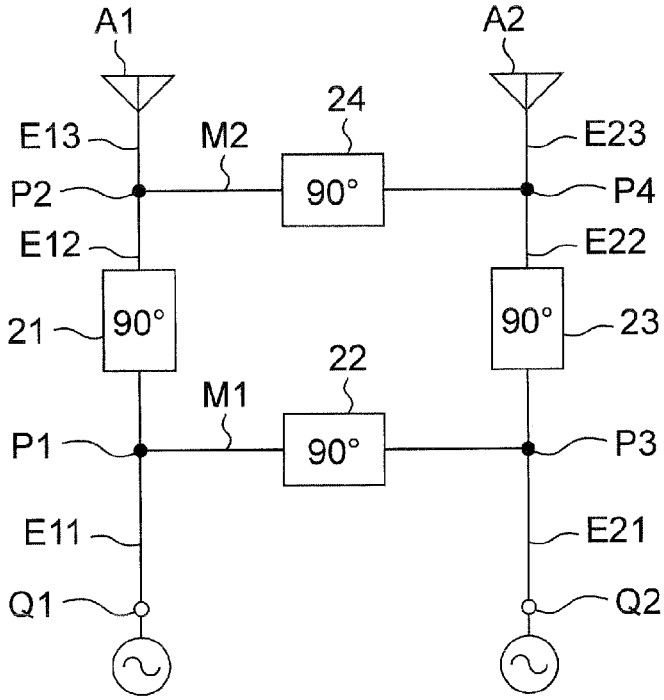
FIG. 15 is a circuit diagram of a portable telephone array antenna apparatus according to a first implemental example of the present invention.

FIG. 15 is a circuit diagram of the portable telephone array antenna apparatus according to the first implemental example of the present invention. Referring to FIG. 15, a 90-degree phase shifter 21 is inserted into the antenna element portion E12, and a 90-degree phase shifter 22 is inserted into the connecting line M1. A 90-degree phase shifter 23 is inserted into the antenna element portion E22, and a 90-degree phase shifter 24 is inserted into the connecting line M2. In the first implemental example of FIG. 15, each electrical length is adjusted so that both the antenna elements A1 and A2 enter resonance states at the frequency f2 on the higher frequency side. In this case, for example, a current path that extends from the connection point P3 via the connecting line M1 to the connection point P1 and a current path that extends from the connection point P3 via the antenna element portion E22, the connecting line M2 and the antenna element portion E12 to the connection point P1 have a phase difference of 180 degrees, and, likewise, the same thing can be said for two current paths that extend from the connection point P1 to the connection point P3. Therefore, the high-frequency signal of the frequency f1 on the lower frequency side can be cancelled at the connection point P1 or P2, and the array antenna apparatus enters a resonance state at the two frequencies f1 and 12, also allowing the predetermined isolation to be obtained between the two antenna elements A1 and A2.

Figure 16:
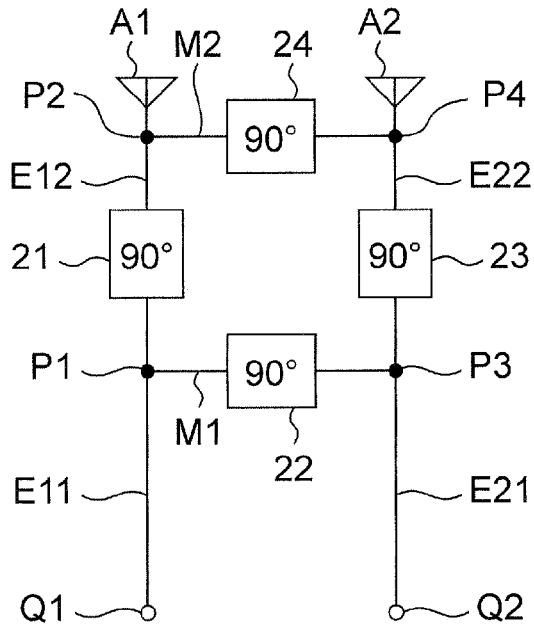
FIG. 16 is a circuit diagram of a portable telephone array antenna apparatus according to a second implemental example of the present invention.

FIG. 16 is a circuit diagram of a portable telephone array antenna apparatus according to the second implemental example of the present invention. The second implemental example of FIG. 16 is characterized in that the antenna element portions E13 and E23 are eliminated (L13=L23=0) in comparison with the first implemental example of FIG. 15. Even with the above configuration, the action and advantageous effect similar to those of the first implemental example of FIG. 15 can be attained.

Figure 17:
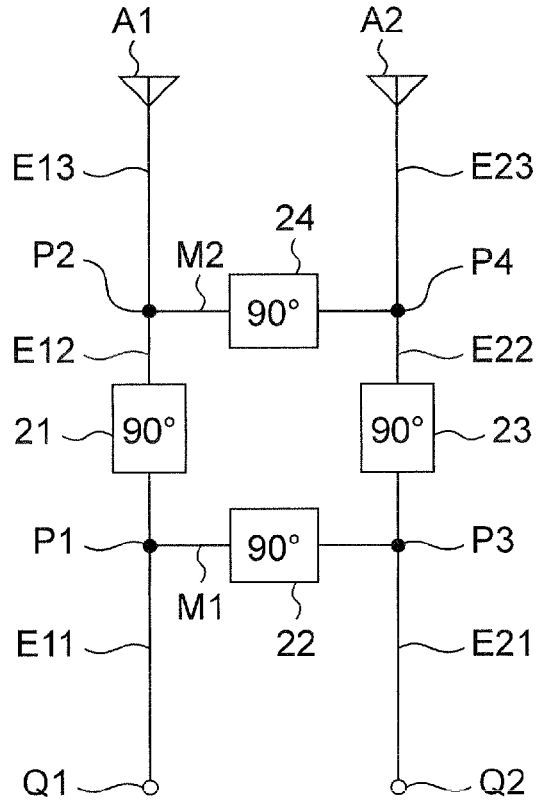
FIG. 17 is a circuit diagram of a portable telephone array antenna apparatus according to a third implemental example of the present invention.

FIG. 17 is a circuit diagram of a portable telephone array antenna apparatus according to the third implemental example of the present invention. The third implemental example of FIG. 17 is such a case similar to that of the first implemental example of FIG. 15, that the electrical lengths of the antenna elements 1 and 2 are identical in the first and third implemental examples and become an integral multiple of the quarter wavelength. Even with the above configuration, the action and advantageous effect similar to those of the first implemental example of FIG. 15 can be attained.

Figure 18:
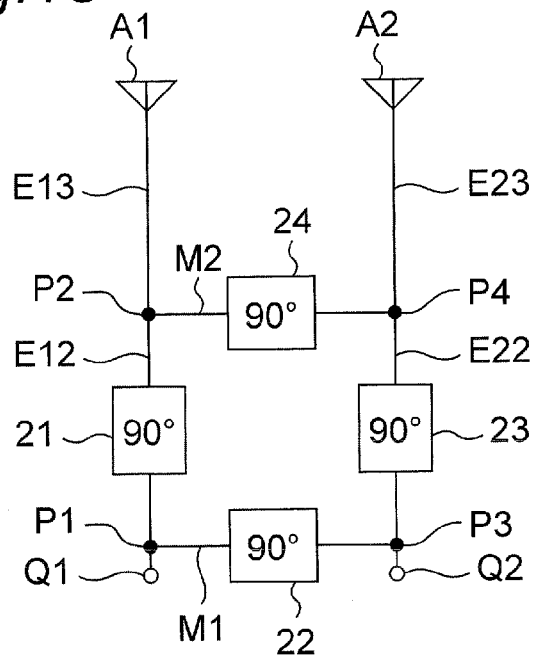
FIG. 18 is a circuit diagram of a portable telephone array antenna apparatus according to a fourth implemental example of the present invention.

FIG. 18 is a circuit diagram of a portable telephone array antenna apparatus according to the fourth implemental example of the present invention. The fourth implemental example of FIG. 18 is characterized in that the antenna element portions E11 and E21 are eliminated (L11=L21=0) in comparison with the third implemental example of FIG. 17. Even with the above configuration, the action and the advantageous effect similar to those of the third implemental example of FIG. 17 can be attained.

Figure 19:
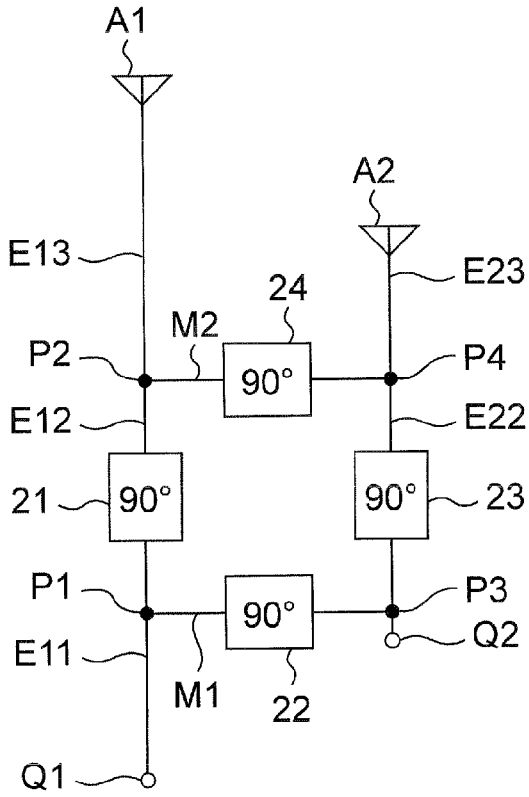
FIG. 19 is a circuit diagram of a portable telephone array antenna apparatus according to a fifth implemental example of the present invention.

FIG. 19 is a circuit diagram of a portable telephone array antenna apparatus according to the fifth implemental example of the present invention. The fifth implemental example of FIG. 19 is characterized in that the antenna element portion E21 is eliminated, and its electrical length is added to the antenna element portion E13 instead of it in comparison with the third implemental example of FIG. 17. Even with the above configuration, the action and advantageous effect similar to those of the third implemental example of FIG. 17 can be attained.

Figure 20:
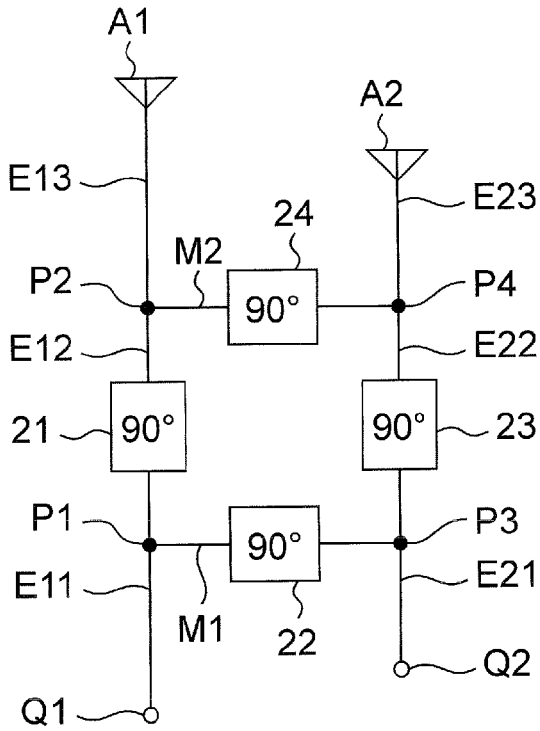
FIG. 20 is a circuit diagram of a portable telephone array antenna apparatus according to a sixth implemental example of the present invention.

FIG. 20 is a circuit diagram of a portable telephone array antenna apparatus according to the sixth implemental example of the present invention. The sixth implemental example of FIG. 20 is such a case similar to that of the third implemental example of FIG. 17, that the electrical lengths of the antenna elements 1 and 2 are varied in the first and third implemental examples but become integral multiples of a quarter of the wavelength. Even with the above configuration, the action and advantageous effect similar to those of the third implemental example of FIG. 17 can be attained.

The following implemental examples 7 to 11 are configured to insert, for example, a parallel resonance circuit so that triple-frequency resonance is achieved.

Figure 21:
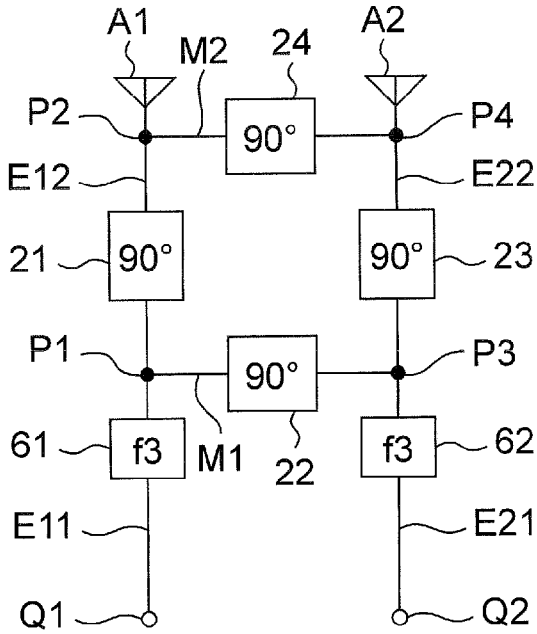
FIG. 21 is a circuit diagram of a portable telephone array antenna apparatus according to a seventh implemental example of the present invention.

FIG. 21 is a circuit diagram of a portable telephone array antenna apparatus according to the seventh implemental example of the present invention. The seventh implemental examples of FIG. 21 is able to resonate at a frequency f3 in addition to the two frequencies f1 and f2 of the second implemental example of FIG. 16 by inserting parallel resonance circuits 61 and 62 each having a resonance frequency of the frequency f3 (f1<f2<f3) into the antenna element portions E11 and E21, respectively, in the second implemental example of FIG. 16. It is noted that the frequency f3 is a resonance frequency that resonates with the electrical length from the feeding points Q1 and Q2 to the parallel resonance circuits 61 and 62, respectively.

The following implemental examples 8 to 11 are each described below in such a case that the resonance frequency of the antenna elements A1 and A2 is set to f0 (f0<f1<f2<f3).

Figure 22:
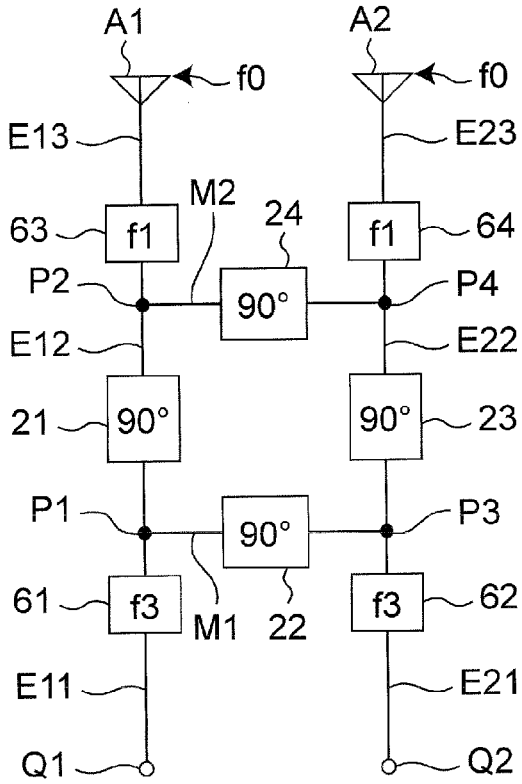
FIG. 22 is a circuit diagram of a portable telephone array antenna apparatus according to an eighth implemental example of the present invention.

FIG. 22 is a circuit diagram of a portable telephone array antenna apparatus according to the eighth implemental example of the present invention. The eighth implemental example of FIG. 22 is able to resonate at the frequencies f0 and f3 in addition to the two frequencies f1 and f2 of the third implemental example of FIG. 17 by inserting parallel resonance circuits 61 and 62 each having a resonance frequency of the frequency f3 (f1<f2<f3) into the antenna element portions E11 and E21, respectively, and inserting parallel resonance circuits 63 and 64 each having a resonance frequency of the frequency f1 into the antenna element portions E13 and E23, respectively, in the third implemental example of FIG. 17.

Figure 23:
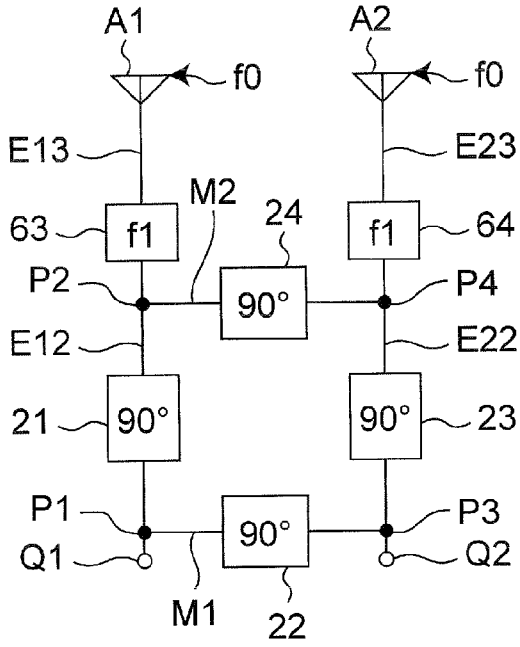
FIG. 23 is a circuit diagram of a portable telephone array antenna apparatus according to a ninth implemental example of the present invention.

FIG. 23 is a circuit diagram of a portable telephone array antenna apparatus according to the ninth implemental example of the present invention. The ninth implemental example of FIG. 23 is characterized in that the antenna element portions E11 and E21 are eliminated in the eighth implemental example of FIG. 22, and this leads to that it is able to resonate at the frequencies f0, f1 and f2.

Figure 24:
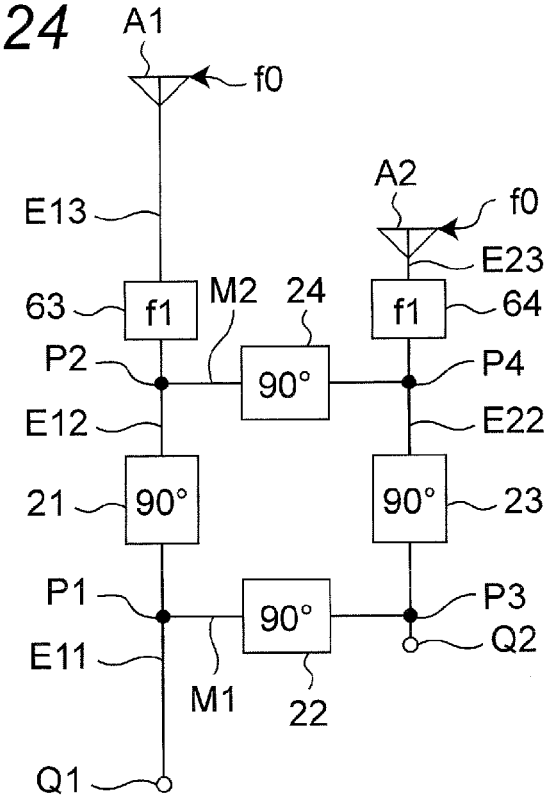
FIG. 24 is a circuit diagram of a portable telephone array antenna apparatus according to a tenth implemental example of the present invention.

FIG. 24 is a circuit diagram of a portable telephone array antenna apparatus according to the tenth implemental example of the present invention. The tenth implemental example of FIG. 24 is able to resonate at the frequency f1 in addition to the two frequencies f0 and f2 of the third implemental example of FIG. 17 by inserting parallel resonance circuits 63 and 64 each having a resonance frequency of the frequency f1 into the antenna element portions E13 and E23, respectively, in the fifth implemental example of FIG. 19.

Figure 25:
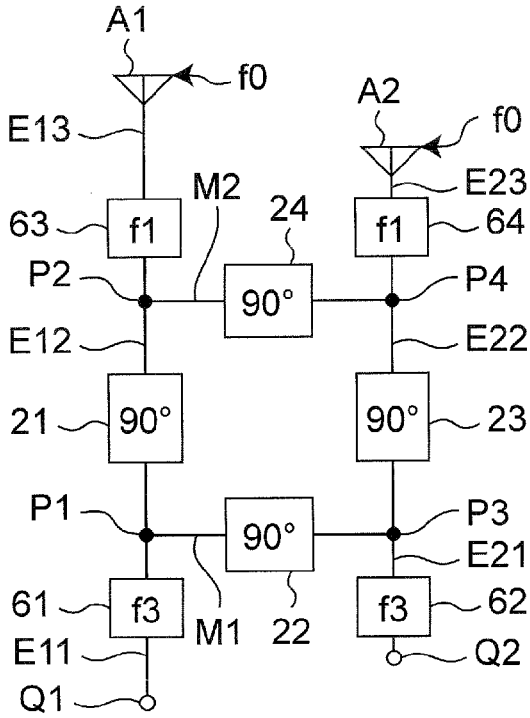
FIG. 25 is a circuit diagram of a portable telephone array antenna apparatus according to an eleventh implemental example of the present invention.

FIG. 25 is a circuit diagram of a portable telephone array antenna apparatus according to the eleventh implemental example of the present invention. The eleventh implemental example of FIG. 25 is able to resonate at the frequencies f1 and f3 in addition to the two frequencies f0 and f2 of the third implemental example of FIG. 17 by inserting parallel resonance circuits 61 and 62 each having a resonance frequency of the frequency f3 (f1<f2<f3) into the antenna element portions E11 and E21, respectively, and inserting parallel resonance circuits 63 and 64 each having a resonance frequency of the frequency f1 into the antenna element portions E13 and E23, respectively, in the sixth implemental example of FIG. 20.

It is noted that the parallel resonance circuits 61 to 64 of FIGS. 21 to 25 are the parallel resonance circuits each of which is configured to include an inductor 31 and a capacitor 32 as shown in, for example, FIG. 48.

Figure 26:
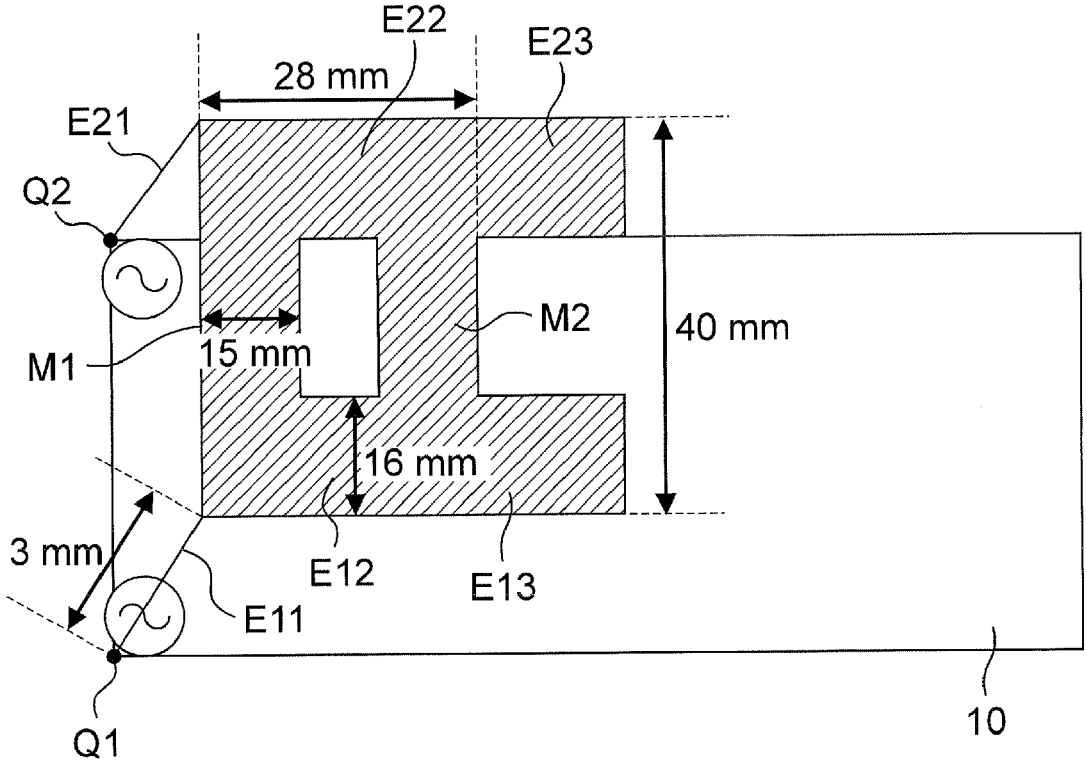
FIG. 26 is a circuit diagram of a portable telephone array antenna apparatus according to a prototype example of the present invention.
Figure 27:
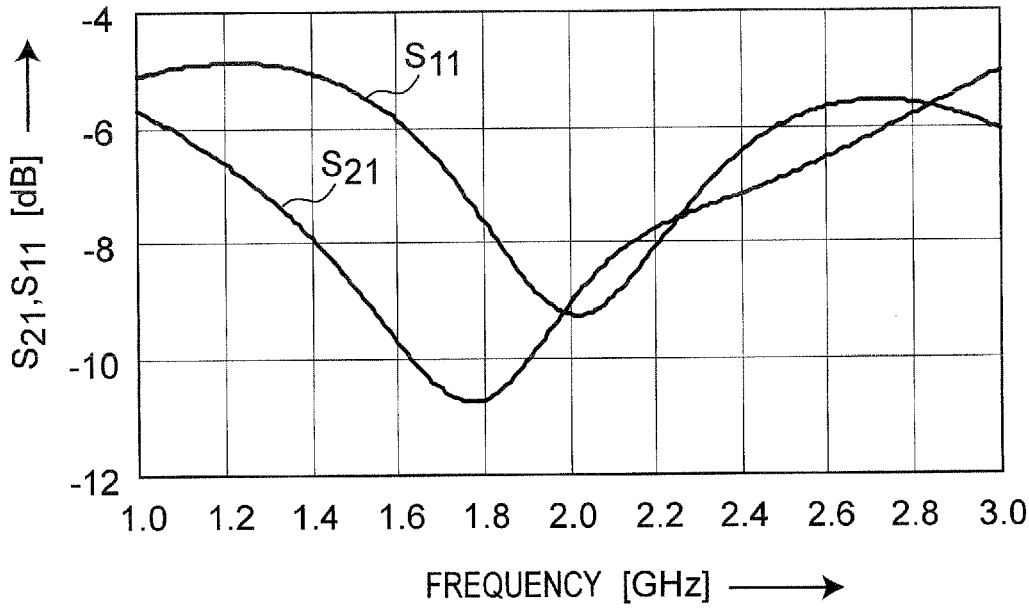
FIG. 27 is a graph showing frequency characteristics of the transmission coefficient $S_{21}$ and the reflection coefficient $S_{11}$ of the portable telephone array antenna apparatus of FIG. 26.
Figure 28:
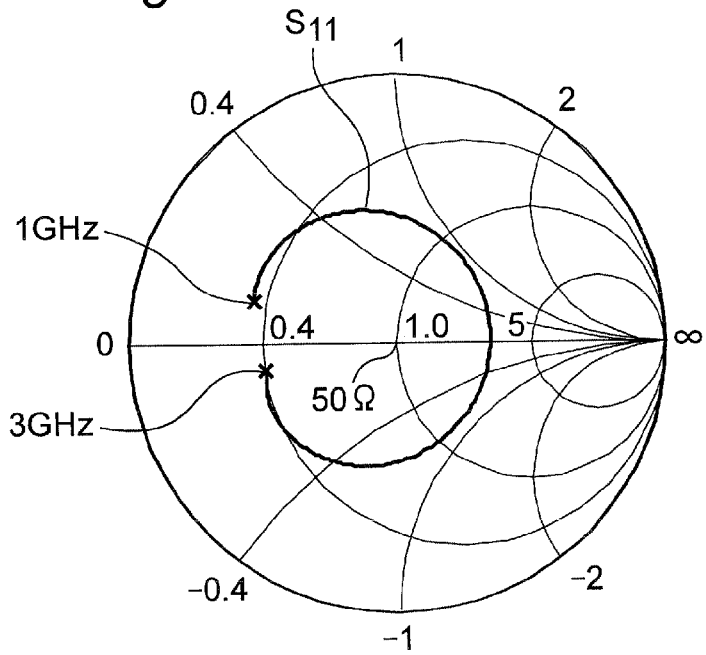
FIG. 28 is a Smith chart showing an impedance characteristic of the reflection coefficient $S_{11}$ of the portable telephone array antenna apparatus of FIG. 26.
Figure 29:
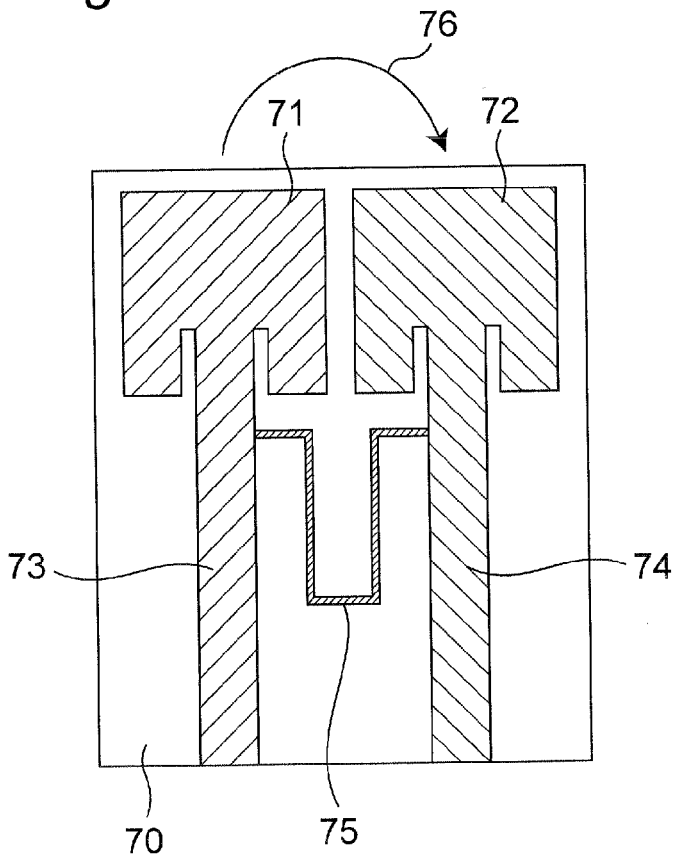
Fig.29 PRIOR ART
FIG. 29 is a plan view of a prior art array antenna apparatus.

FIG. 26 is a circuit diagram of a portable telephone array antenna apparatus according to a prototype example of the present invention. FIG. 27 is a graph showing frequency characteristics of the transmission coefficient $S_{21}$ and the reflection coefficient $S_{11}$ of the portable telephone array antenna apparatus of FIG. 26, and FIG. 28 is a Smith chart showing an impedance characteristic of the reflection coefficient $S_{11}$ of the portable telephone array antenna apparatus of FIG. 26. The portable telephone array antenna apparatus of the prototype example was experimentally produced by the present inventor and the others and corresponds to the portable telephone array antenna apparatus of FIG. 14. In this case, the present inventor and the others produced the prototype by designing the line height and the line width with a characteristic impedance of 50Ω. As is apparent from FIGS. 27 and 28, it can be understood that the impedance is matched at 2 GHz, and the isolation is maximized in the vicinity of a lower frequency of about 1.8 GHz.

Although the current paths are K1 and K2 in the above preferred embodiments, the present invention is not limited to this but allowed to be signal paths including the current paths. Moreover, the feeding points Q1 and Q2 may be mutually exchanged in configuration.

Industrial Applicability

According to the array antenna apparatus and the wireless communication apparatus of the present invention, they can be implemented as, for example, the portable telephone or implemented as the apparatus for a wireless LAN. The antenna apparatus, which can be mounted on a wireless communication apparatus for performing, for example, MIMO communication, can also be mounted on the wireless communication apparatus for other arbitrary communications that need a great isolation between feeding elements without being limited to MIMO.

Reference Numerals

1, 2: Antenna element;
1*a*, 1*b*, 2*a*, 2*b*, E11, E12, E13, E21, E22, E23: Antenna element portion;
3: Wireless communication circuit;
10: Circuit board;
11: Grounding conductor;
20: Phase shifter circuit;
21 to 24: 90-degree phase shifter;
25, 26: Phase shifter;
31, 33, 35: Inductor;
32, 34, 36: Capacitor;
41, 42: Parallel resonance circuit;
51, 52: Plate-shaped antenna element;
53, 54: Inductor;
55: Extended antenna element portion;
61 to 64: Parallel resonance circuit;
101 to 106: Portable telephone array antenna apparatus;
A1, A2: Antenna element;
K1, K2: Current path;
M1, M2: Connecting line;
P1, P2, P3, P4: Connection point; and
Q1, Q2: Feeding point.

What is claimed is:

1. An array antenna apparatus comprising:

a first antenna element connected to a first feeding point, the first antenna element resonating at a first frequency; and a second antenna element connected to a second feeding point, the second antenna element resonating at the first frequency, a first connecting line for electrically connecting the first connection point located in the first antenna element with a third connection point located in the second antenna element; and a second connecting line for electrically connecting the second connection point located in the first antenna element with a fourth connection point located in the second antenna element, and wherein an electrical length of each of the first and second antenna elements and an electrical length of each of the first and second connecting lines are set so that a phase difference, between a first high-frequency signal propagating through a first signal path that extends from the second feeding point via the third connection point, the first connecting line and the first connection point to the first feeding point, and a second high-frequency signal propagating through a second signal path that extends from the second feeding point via the fourth connection point, the second connecting line and the second connection point to the first feeding point, becomes substantially 180 degrees at the first feeding point, whereby the array antenna apparatus resonates at a plurality of frequencies including the first frequency and a second frequency higher than the first frequency.

2. The array antenna apparatus as claimed in claim 1, wherein the phase difference is set so as to become substantially 180 degrees at an averaged frequency of the first frequency and the second frequency.

3. The array antenna apparatus as claimed in claim 2, further comprising:

a first phase shifter connected between the first connection point and the second connection point;

a second phase shifter connected between the first connection point and the third connection point;

a third phase shifter connected between the third connection point and the fourth connection point; and a fourth phase shifter connected between the second connection point and the fourth connection point.

4. The array antenna apparatus as claimed in claim 3, wherein each of the first to fourth phase shifters is a 90-degree phase shifter for shifting a phase of an inputted high-frequency signal substantially by 90 degrees and outputting a phase-shifted signal.

5. The array antenna apparatus as claimed in claim 4, wherein each of the first to fourth phase shifters is a low-pass filter for interrupting a high-frequency signal including the second frequency, and wherein the low-pass filter is configured to include an inductor and a capacitor.

6. The array antenna apparatus as claimed in claim 3, wherein each of the first to fourth phase shifters is a low-pass filter for interrupting a high-frequency signal including the second frequency, and wherein the low-pass filter is configured to include an inductor and a capacitor.

7. The array antenna apparatus as claimed in claim 3, wherein each of the first to fourth phase shifters is a parallel resonance circuit having a resonance frequency of the second frequency and interrupting a high-frequency signal having the second frequency, and wherein the parallel resonance circuit is configured to include an inductor and a capacitor.

8. The array antenna apparatus as claimed in claim 3, wherein each of the first to fourth phase shifters includes a parallel resonance circuit and a series resonance circuit, wherein the parallel resonance circuit is configured to have a resonance frequency of the second frequency, interrupt the high-frequency signal having the second frequency, and include an inductor and a capacitor, and wherein the series resonance circuit is configured to have a resonance frequency of the first frequency, allow the high-frequency signal having the first frequency to pass therethrough, and include an inductor and a capacitor.

9. The array antenna apparatus as claimed in claim 2, wherein the first antenna element and the second antenna element are configured, to become mutually asymmetrical circuits.

10. The array antenna apparatus as claimed in claim 2, wherein a parallel resonance circuit having a further resonance frequency other than the first frequency and the second frequency is inserted into at least one location of the first antenna element and the second antenna element, the location excluding:

a position located between the first connection point and the second connection point, between which the first phase shifter is connected;

a position located between the first connection point and the third connection point, between which the second phase shifter is connected;

a position located between the third connection point and the fourth connection point, between which the third phase shifter is connected; and a position located between the second connection point and the fourth connection point, between which the fourth phase shifter is connected, whereby the array antenna apparatus resonates at the further resonance frequency other than the first frequency and the second frequency.

11. The array antenna apparatus as claimed in claim 1, further comprising:

a first phase shifter connected between the first connection point and the second connection point;

a second phase shifter connected between the first connection point and the third connection point;

a third phase shifter connected between the third connection point and the fourth connection point; and a fourth phase shifter connected between the second connection point and the fourth connection point.

12. The array antenna apparatus as claimed in claim 11, wherein each of the first to fourth phase shifters is a 90-degree phase shifter for shifting a phase of an inputted high-frequency signal substantially by 90 degrees and outputting a phase-shifted signal.

13. The array antenna apparatus as claimed in claim 12, wherein each of the first to fourth phase shifters is a low-pass filter for interrupting a high-frequency signal including the second frequency, and wherein the low-pass filter is configured to include an inductor and a capacitor.

14. The array antenna apparatus as claimed in claim 11, wherein each of the first to fourth phase shifters is a low-pass filter for interrupting a high-frequency signal including the second frequency, and wherein the low-pass filter is configured to include an inductor and a capacitor.

15. The array antenna apparatus as claimed in claim 11, wherein each of the first to fourth phase shifters is a parallel resonance circuit having a resonance frequency of the second frequency and interrupting a high-frequency signal having the second frequency, and wherein the parallel resonance circuit is configured to include an inductor and a capacitor.

16. The array antenna apparatus as claimed in claim 11, wherein each of the first to fourth phase shifters includes a parallel resonance circuit and a series resonance circuit, wherein the parallel resonance circuit is configured to have a resonance frequency of the second frequency, interrupt the high-frequency signal having the second frequency, and include an inductor and a capacitor, and wherein the series resonance circuit is configured to have a resonance frequency of the first frequency, allow the high-frequency signal having the first frequency to pass therethrough, and include an inductor and a capacitor.

17. The array antenna apparatus as claimed in claim 1, wherein the first antenna element and the second antenna element are configured to become mutually asymmetrical circuits.

18. The array antenna apparatus as claimed in claim 1, wherein a parallel resonance circuit having a further resonance frequency other than the first frequency and the second frequency is inserted into at least one location of the first antenna element and the second antenna element, the location excluding:

a position located between the first connection point and the second connection point, between which the first phase shifter is connected;

a position located between the first connection point and the third connection point, between which the second phase shifter is connected;

a position located between the third connection point and the fourth connection point, between which the third phase shifter is connected; and a position located between the second connection point and the fourth connection point, between which the fourth phase shifter is connected, whereby the array antenna apparatus resonates at the further resonance frequency other than the first frequency and the second frequency.

19. A wireless communication apparatus comprising:

an array antenna apparatus; and a wireless communication circuit for performing wireless communications by using the array antenna apparatus, wherein the array antenna apparatus comprises:

a first antenna element connected to a first feeding point, the first antenna element resonating at a first frequency; and a second antenna element connected to a second feeding point, the second antenna element resonating at the first frequency, a first connecting line for electrically connecting the first connection point located in the first antenna element with a third connection point located in the second antenna element; and a second connecting line for electrically connecting the second connection point located in the first antenna element with a fourth connection point located in the second antenna element, and wherein an electrical length of each of the first and second antenna elements and an electrical length of each of the first and second connecting lines are set so that a phase difference, between a first high-frequency signal propagating through a first signal path that extends from the second feeding point via the third connection point, the first connecting line and the first connection point to the first feeding point, and a second high-frequency signal propagating through a second signal path that extends from the second feeding point via the fourth connection point, the second connecting line and the second connection point to the first feeding point, becomes substantially 180 degrees at the first feeding point, whereby the array antenna apparatus resonates at a plurality of frequencies including the first frequency and a second frequency higher than the first frequency.

* * * * *